US011425985B2

(12) United States Patent
Megesi

(10) Patent No.: US 11,425,985 B2
(45) Date of Patent: Aug. 30, 2022

(54) PORTABLE BEAUTY TOOL ASSEMBLY

(71) Applicant: Vango, LLC, Jonesboro, GA (US)

(72) Inventor: Dominique Megesi, Jonesboro, GA (US)

(73) Assignee: VANGO, LLC, Jonesboro, GA (US)

( * ) Notice: Subject to any disclaimer, the term of this patent is extended or adjusted under 35 U.S.C. 154(b) by 36 days.

(21) Appl. No.: 16/739,102

(22) Filed: Jan. 9, 2020

(65) Prior Publication Data

US 2020/0214426 A1 Jul. 9, 2020

Related U.S. Application Data

(60) Provisional application No. 62/790,382, filed on Jan. 9, 2019.

(51) Int. Cl.
*A45D 42/12* (2006.01)
*A45D 42/16* (2006.01)

(52) U.S. Cl.
CPC ..... *A45D 42/12* (2013.01); *A45D 42/16* (2013.01)

(58) Field of Classification Search
CPC ..... A45D 42/12; A45D 42/16; A45D 42/20
USPC ..... 359/879, 880
See application file for complete search history.

(56) References Cited

U.S. PATENT DOCUMENTS 433,708 A * 8/1890 Wiederer
898,263 A * 9/1908 Rice
893,998 A 11/1908 Harris
956,032 A 4/1910 Birdwell
956,274 A * 4/1910 Birdwell
1,029,420 A 6/1912 Buzby
1,391,491 A * 9/1921 O'Donnell ..... A47B 19/002 248/461
1,486,534 A 3/1924 Munn
(Continued)

FOREIGN PATENT DOCUMENTS

EP 2700329 A1 2/2014
JP 3137863 U 12/2007
KR 2020100011035 U 11/2010

OTHER PUBLICATIONS

International Search Report and Written Opinion dated Mar. 20, 2020 cited in Application No. PCT/US2020/012998, 19 pgs.

*Primary Examiner* — Ricky D Shafer
(74) *Attorney, Agent, or Firm* — Gibraltar Consulting LLC; Tariq S. Najee-Ullah

(57) ABSTRACT

Methods and an apparatus for providing a portable beauty tool assembly is described. The assembly includes multiple accessories, such as a mirror, tray, and container that may be useful as beauty tools. Further, the assembly has a unique structure that allows the apparatus to be adjusted into several different functional positions. Each position configures the assembly for hands-free use of the multiple accessories. The assembly can be placed into a vertical hanging position, a neck position, a leg position, or a tabletop position. The assembly includes a plurality of adjustable arms that provide the adjustable movement, such as extending, collapsing, and rotating, that is necessary for configuring the assembly into the various functional positions. Additionally, the assembly includes a hook arm, which can be used for attaching, securing, or stabilizing the various functional positions. The assembly can include additionally accessories, such as lights, tray inserts and mirrors having different magnifications.

18 Claims, 12 Drawing Sheets

(56) References Cited

U.S. PATENT DOCUMENTS

| | | | | | |
|---|---|---|---|---|---|
| 1,509,746 | A | * | 9/1924 | Zeidler | A45D 42/12 359/874 |
| 1,992,523 | A | | 2/1935 | Dupret | |
| 2,071,243 | A | * | 2/1937 | Tripp | A45D 42/12 359/880 |
| 2,117,403 | A | | 5/1938 | Crosby | |
| 2,266,977 | A | | 12/1941 | Lynch | |
| 2,277,241 | A | | 3/1942 | Lynch | |
| 2,312,608 | A | | 3/1943 | Wadsack | |
| 2,334,610 | A | | 11/1943 | Crawford | |
| 2,352,819 | A | | 7/1944 | Winslow | |
| 2,379,214 | A | | 6/1945 | Bolinger | |
| 2,583,803 | A | | 1/1952 | Amer | |
| 3,476,123 | A | | 11/1969 | Flax | |
| 4,292,748 | A | | 10/1981 | Miller | |
| 4,707,087 | A | | 11/1987 | Van Zandt | |
| 4,860,989 | A | | 8/1989 | Rose et al. | |
| 5,301,068 | A | * | 4/1994 | Minisci | G02B 7/1824 248/472 |
| 5,359,461 | A | | 10/1994 | Rice et al. | |
| 6,099,133 | A | | 8/2000 | Wright | |
| 7,063,427 | B1 | | 6/2006 | Cutler | |
| 8,499,933 | B2 | | 8/2013 | Ziemba | |
| 8,939,591 | B1 | | 1/2015 | Reynolds | |
| 2003/0142424 | A1 | | 7/2003 | Mangano | |
| 2008/0245104 | A1 | | 10/2008 | Steele | |
| 2016/0051034 | A1 | | 2/2016 | Nikolov et al. | |
| 2017/0303667 | A1 | | 10/2017 | Lopez | |

* cited by examiner

PORTABLE BEAUTY TOOL ASSEMBLY

RELATED APPLICATIONS

This application claims the benefit of U.S. Provisional Patent Application No. 62/790,382, filed on Jan. 9, 2019, the contents of which is incorporated herein by reference in its entirety.

Related (PCT) International Application No. PCT/US2020/012998 filed on Jan. 9, 2020, entitled "PORTABLE BEAUTY TOOL ASSEMBLY," assigned to the assignee of the present application, is hereby incorporated by reference.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure generally relates to mirrors, pocket, hand, or handbag mirrors; and casings or accessories for storing or handling solid or pasty toilet or cosmetic substances.

BACKGROUND OF THE DISCLOSURE

In some situations, a person may desire to apply beauty products, cosmetics or medical ointments to their face while looking in the mirror. For example, a person may need to apply mascara in a particular manner to their eyes. In another instance, a person may desire to apply acne medication to a pimple located on their face. The conventional strategy is to apply the cosmetics or medical ointments while looking in a bathroom mirror or stationary mirror. While this may be optimal, this is not always possible. For example, someone may desire to apply makeup, cosmetics, or ointment in an environment where a bathroom mirror is unavailable. Additionally, a bathroom mirror may not provide the most appropriate magnification that is desired.

In such an instance, the conventional strategy is to use a pocket, hand, or handbag mirror. This often causes problems because the conventional strategy does not allow a person to use both hands to apply the desired materials to the face. One hand is always required to hold the mirror in place. For example, while the person is applying the mascara, acne medication, or a cosmetic with one hand, they are restricted to utilizing the opposing hand to hold the mirror.

Accordingly, there remains a need for improved method of applying mascara, acne medication, a cosmetic, or other material to a face while utilizing a mirror that allows for freedom of movement and free use of both hand simultaneous. This need and other needs are satisfied by the various aspects of the present disclosure.

BRIEF OVERVIEW

A portable beauty tool assembly may be provided. This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

Consistent with embodiments of the present disclosure, a mirror and assembly may be provided. The mirror and assembly may be used by individuals or companies to utilize a collapsible, hands free, cosmetics mirror in hanging, standing, wearable, collapsed, and other positions of operation.

In one aspect, the mirror and assembly may be a beauty tool, vanity accessory, or Cosmetics apparatus. In another aspect, the mirror and assembly may be used in a manner similar to a typical makeup mirror or a vanity table, for example in its collapsed form. In yet another aspect, the mirror and assembly provide operative ability to be collapsed and be used in one or more different positions of operation.

In one instance, a mirror and assembly may comprise one or more elongated members or arms that may be coupled together at a variety of connecting points. Connecting points may be joined or coupled using but not limited to: magnets, hinges, fasteners, interlocking components, rotating components, interlocking rotating components, fixed components, lubricated components, and the likeness thereof. In at least one instance, mirror and assembly be manipulating into various positions including a collapsed position and an expanded position wherein mirror and assembly may work to make the mirror and tray adjustable such that the tool can be further manipulated to be worn, hung, or placed on a table.

In accordance with the purposes of the disclosure, as embodied and broadly described herein, the disclosure, in one aspect, relates to a mirror and assembly, such as, for example collapsible mirror assembly. In further aspects, a mirror and assembly may be used as a hands-free mirror.

In another aspect, the disclosure relates to a mirror and assembly which may be a hands-free mirror apparatus configured to function in one or more configurations. In a first possible configuration, mirror and assembly may be worn (i.e., around the neck, around a shoulder, etc. beneath the leg). In a second possible configuration, mirror and assembly may be placed on a table and adjusted to the height of a seated person. In a third possible configuration, mirror and assembly may be hung on a vertical surface. The hanging means need not be integrated into the assembly.

In further aspects, the disclosure also relates to a mirror and assembly which may further comprise a storage container or tray which may be used as an "on-the-go" vanity that would be used in a manner similar to an at-home vanity. However, as part of mirror and assembly, the storage container or tray may be portable. Further, in other instances, the disclosure may relate to a storage container which may have a closure mechanism that works with an adjoining magnet that may allow objects to be enclosed within the storage container.

In further aspects, a mirror and assembly may further comprise a mirror and a mirror box. Mirror and assembly may comprise a double-sided mirror. In some instances, the mirror and assembly comprise a mirror having different magnifications. In other embodiments, mirror and assembly may comprise a detachable mirror box and detachable mirror such that multiple mirrors may be used with the mirror and assembly interchangeably.

In further aspects, the disclosure relates to a mirror and assembly configured such that when worn, the placement of the plurality of members or arms may cause the mirror and assembly to be offset from the center of the body. Such a configuration may provide for a left-handed orientation and a right-handed orientation for a user. Furthermore, this may provide mirror and assembly with both left-handed orientations and right-handed orientations allowing mirror and assembly to be completely ambidextrous.

As it relates to the present disclosure, the mirror and assembly may comprise one elongated member, two elongated members, or any plurality of elongated members. The shape and size of the components and members of mirror and assembly may be varied depending on the height or size of the user. In yet other embodiments, even larger versions of the mirror and assembly may be utilized for various situations as deemed necessary.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

Additional aspects of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are explanatory only and are not restrictive of the disclosure, as claimed.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE DISCLOSURE

Figure 1:
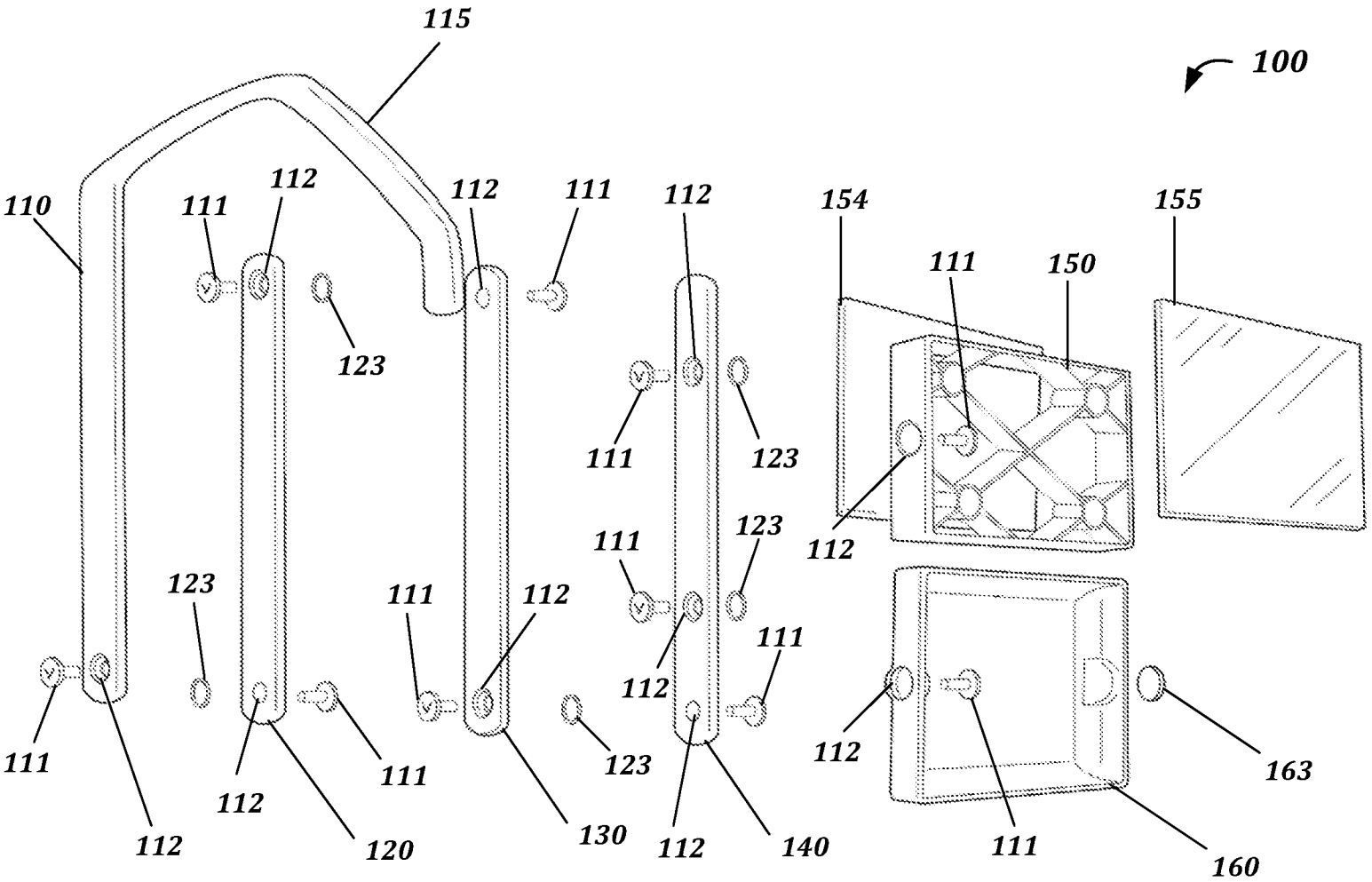
FIG. 1 is an exploded view of a portable beauty tool assembly including a mirror and tray, in accordance with an embodiment of the present disclosure.

The present disclosure includes many aspects and features. Moreover, while many aspects and features relate to, and are described in, the context of portable beauty tool assembly for cosmetics, embodiments of the present disclosure are not limited to use only in this context. The present disclosure can be understood more readily by reference to the following detailed description of the disclosure and the Examples included therein.

Before the present articles, systems, apparatuses, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this disclosure belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed apparatuses, systems, and articles of the disclosure as well as the apparatuses themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and apparatuses of the disclosure. Thus, if there are a variety of additional steps that can be performed it is understood that each of these additional steps can be performed with any specific aspect or combination of aspects of the methods of the disclosure.

It is understood that the apparatuses and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Consistent with embodiments of the present disclosure, a portable beauty tool assembly may be provided. This overview is provided to introduce a selection of concepts in a simplified form that are further described below. This overview is not intended to identify key features or essential features of the claimed subject matter. Nor is this overview intended to be used to limit the claimed subject matter's scope. The mirror and assembly may be used by individuals or companies to utilize a collapsible, hands free, cosmetics mirror in a hanging, standing, wearable, or collapsed position of operation.

The portable beauty tool assembly 100 is a multifaceted tool, and may be used as a beauty tool, a vanity accessory, or apparatus for cosmetics and/or grooming products. In another aspect, the assembly 100 may be used in a manner similar to a typical wall-mounted makeup mirror or a vanity table, for example in its collapsed form. In yet another aspect, the assembly 100 provides operative ability to be collapsed and be used in at least three different functional positions. For instance, the assembly 100, manipulating into a collapsed position or an expanded position, wherein the assembly may work in manner that further make the mirror box 150 and tray 160 adjustable such that the tool can be further manipulated to be worn, hung, or placed on a table.

Referring particularly to FIG. 1, an exploded view of the portable beauty tool assembly 100 is shown. In general, the portable beauty tool assembly 100 can be described as being comprised of six principle parts (or assembly elements), including: a hook arm 110; a hook adjustable arm 120; a middle adjustable arm 130; an accessory adjustable arm 140; a mirror box 150; and a tray 160. The portable beauty tool assembly 100 can be comprised of a sturdy, yet slightly flexible material, such a light metal or plastic, which allows the portable beauty tool assembly 100 to be a substantially lightweight (e.g., for ease of portability), adjustable, and rigid apparatus. The assembly 100 may be constructed from other materials, such as a metallic magnetized material, plastic material, wooden materials, composite materials, a 3-D printing ribbon cable, and other suitable materials.

The portable beauty tool assembly 100 is particularly designed to allow the tool's 100 form to be adjusted and re-configured into several different functional positions (shown in FIGS. 6A-8B). Accordingly, the portable beauty tool assembly 100 can remain stable in the desired functional position, and securely hold items (such as beauty products) that may be set on the tray 160 in that position. Due to its adjustable design and multiple configurations, the portable beauty tool assembly 100 can be a multi-purpose beauty tool, having accessories and functions that serve in various forms related to a user's beauty (and grooming) needs, such as a travel mirror, a table mirror, a hands-free beauty tray, wall mirror, and the like.

The hook arm 110 can be an elongated (e.g., long with respect to length and substantially narrow with respect to width) and rigid, member that is structured geometrically as a "U" shaped bar or rod. As seen, the hook arm 110 can be described as having two portions, such as: a hooked portion 115, which is the top (or head) of the portion of the hook arm 110 that is curved, bent, or otherwise hooked, in shape; and an extended portion 116, which is the portion of the hook arm 110 that is primarily linear (or rectilinear) and long with respect to the latitudinal axis (e.g., length). The curvature, or bent portion, of the hooked portion 115 of the hook arm's 110 "U" shape is particularly formed to operate in different capacities based on the particular configuration that the tool 100 is set in. For example, the "U" shape of the hook arm 110 has a curve that can securely rest against the neck of a user in a neck configuration (shown in FIGS. 7A-7B), or function as a widened (e.g., radius of the curve) base of the tool 110 in a table configuration (shown FIGS. 6A-6B), or that can be securely placed around, or affixed to, an extended portion of a stationary surface, such as a wall, in a hanging configuration (shown in FIGS. 4A-4B). The hook arm 110 can have an aperture 112 that is disposed on the end of the extended portion 116, which can be used to attach the tool's hook adjustable arm 120 thereto.

The portable beauty tool assembly 100 can include multiple adjustable arms, shown as the hook adjustable arm 120, the middle adjustable arm 130, and the accessory adjustable arm 140. After the assembly 100 is fully assembled, the arms 120, 130, and 140 can be sequentially coupled together at connecting points. Connecting points may be magnets, hinges, fasteners, interlocking components, rotating component, interlocking rotating components, fixed components, lubricated components, and the likeness thereof.

The arms 120, 130, 140 can be somewhat similar to the hook arm 110, being elongated (e.g., long with respect to length and substantially narrow with respect to width) and rigid members. The adjustable arms 120, 130, 140 are structured geometrically as linearly (or rectilinear) shaped bars or rods. Each of the arms 120, 130, 140 have apertures disposed thereon, and corresponding attachment mechanisms, shown as rivets and gaskets. In some embodiments, attachment mechanisms may comprise various different connecting means and/or rotating connecting means including but not limited to: interlocking screws, hinges, dowels, rods, interlocking dowels, metal rivets with silicon gaskets, rivets and gaskets, interlocking rods, magnets with magnetized metal interlocking pegs, hook and loop system, an interlocking fastener means, a fastener means, and any other suitable fasteners or interlocking means.

In detail, the illustrated example shows: the hook adjustment arm 120 including apertures 112 and corresponding to rivets 111 and gaskets 123; the middle adjustment arm 130 including apertures 112 and corresponds to rivets 111 and gaskets 123; and the accessory adjustment arm 140 including apertures 112 and corresponds to rivets 111 and gaskets 123.

These attachment mechanisms (apertures, rivets, gaskets) can function in concert to form attachment points that allow another element to be attached to each of the adjustable arms 120, 130, 140, respectively. Thus, the attachment points on the adjustable arms 120, 130, and 140 can be a hinged point, that allows for some of the tool's adjustable movements (e.g., swivel, extend, contract). In FIG. 1, the hook adjustable arm 120 includes aperture 112 that is disposed on an end of the arm 120 that is proximal to the aperture 112 on the extended portion 116 of the hook arm 110. In an example, when assembling the tool 100, rivets 111 can be inserted into apertures 112 respectively in order to securely attach the hook adjustable arm 120 to the end of the hook arm 110.

Also, the hook adjustable arm 120 includes another aperture 111 that is disposed on an opposing end (with respect to aperture 112) of the arm 120. This aperture 112 (using the corresponding rivet 111 and gasket 123) can be used to attach the hook adjustable arm 120 to the middle adjustable arm 130 (using aperture 112 and corresponding rivet 111). The middle adjustable arm 120 has another aperture 112 in its opposing end, which can be used to attach the middle adjustable arm 130 (using corresponding rivet 111 and gasket 123) to the accessory adjustable arm 140 (using aperture 112 and corresponding rivet 111 and gasket 123). The accessory adjustable arm 140 has another aperture 112 in its opposing end, which can be used to attach the accessory adjustable arm 140 (using corresponding rivet 111 and gasket 123) to the tool's 100 accessories, name the tray 160 and mirror box 150.

The adjustable arms 120, 130, 140 of the portable beauty tool assembly 100 can individually collapse and expand to different heights, widths (extended from the body of the assembly 100), and positions. Accordingly, movement of the adjustable arms 120, 130, 140 can provide many aspects of the tool's structure that secures multiple accessories (e.g., mirror box 150 and tray 160) to the assembly 100. Furthermore, the unique design and function of the adjustable arms 120, 130, 140 allow the assembly 100 to be adaptively re-configured for comfortable wear by a user, steady hanging on a wall, or stable placement on a table, in a position that meets the specific needs of the user. In other words, the assembly 100 supports multiple hands-free functions for multiple different accessory options, in manner that is an improvement over many current products in the beauty/care industry. Often times, while applying beauty products or during grooming, a user would need to hold a mirror (handheld mirror). Thus, the user has only a single hand that is available, making some beauty related tasks (e.g., cream application, makeup application) extremely difficult. Moreover, the assembly 100 provides an aspect of portability, by incorporating a compact design with smaller accessories that can serve the same function as objects that are typically larger and immobile, for example wall mounted mirrors and at-home vanities.

In the example of FIG. 1, the portable beauty tool assembly 100 includes accessories, shown as the mirror box 150 and tray 160. The mirror box 150 is structured as a quadrilateral frame or box, where the box 150 can house a first mirror 155 forming a mirrored lateral flat surface of the box 150. A second mirror 154 can be housed by the box 150 forming another mirrored lateral flat surface of the box 150. In some cases, the mirrors 154, 155 can have varying degrees of magnification (e.g., mirror 155-1X and mirror 154-2X) that affords even greater variety in the attached accessories. Also, the mirror box 150 can include an aperture 152 (and corresponding rivet 151) that can be used for attaching to the accessory arm 140. The mirrors 154, 155 can be configured for various magnifications as deemed appropriate. In other embodiments, the mirror box 150 may comprise a detachable mirror assembly, including individually detachable mirrors, such that the various mirrors may be used with the mirror and assembly 100 interchangeably.

Also shown in FIG. 1, as an element of the portable beauty tool assembly 100 is the tray 160. The tray 160 can be structured generally similar to the mirror box 150, having a quadrilateral, or shallow box, form. In addition, tray 160 has a side comprising an enclosing surface and an opposing open side. With this structure, the tray 160 can be an accessory of the assembly 100 that functions as a receptacle to hold objects, such as beauty products. Thus, the tray 160 can have a flat surface as a bottom and a raised rim extending towards its opening, allowing this accessory to serve as a carrying tray to rest items upon while a person uses the mirror 155, for example. Also, the tray 160 can include an aperture 162 (and corresponding rivet 161) and magnet 163, disposed on opposite ends of the tray (e.g., rims/edges of the tray 160) that can be used to fixedly attach the tray 160. For instance, the assembly 100 can be put together by attaching the accessories to the accessory adjusting arm 140 by inserting the rivet 141*c* into aperture 142*c* to couple to mirror box 150 (using aperture 152 and corresponding rivet 151) and inserting the rivet 111 into aperture 112 to couple to tray 160 (using aperture 162 and corresponding rivet 161). Even further, the magnet 163 of tray 160 allows (e.g., easily attach and remove) the corresponding side to be temporarily affixed to another surface, providing more stability with the tray 160. In other instances, the magnet 163 can function as a closure mechanism that works with an adjoining magnet that allows the user to keep needed objects close at hand and enclosed within the tray 160.

Therefore, the tray 160 of the portable beauty tool assembly 100 provides a "storage" that would typically accompany an at-home vanity, but in the form of a small tray (and adjoining magnet 163) allowing needed beauty items to be close at hand while the tool 100 is in use. In further instances, the tray 160 can be used as a receptacle, or container, serving as an "on-the-go" vanity that would be otherwise be embodied in ab at-home vanity. However, the portable beauty tool assembly 100 has a structure that lends itself for portability, unlike its traditional stationary, at-home, counterparts.

It should be appreciated that FIG. 1 is an example of a configuration for the portable beauty tool assembly 100, and in other embodiments, the elements may be varied by plurality of numbers, sizes, and the like. The structure of the assembly 100, such as shape, size, and form of the components may vary as deemed necessary, depending on certain variables, such as the height or size of the users, or attaching elements (e.g., knob, hooks, doors, walls, etc.). In yet other embodiments, even different versions of the assembly's 100 elements, for instance a larger mirror 155, and may be utilized for various situations as deemed necessary.

Figure 2A:
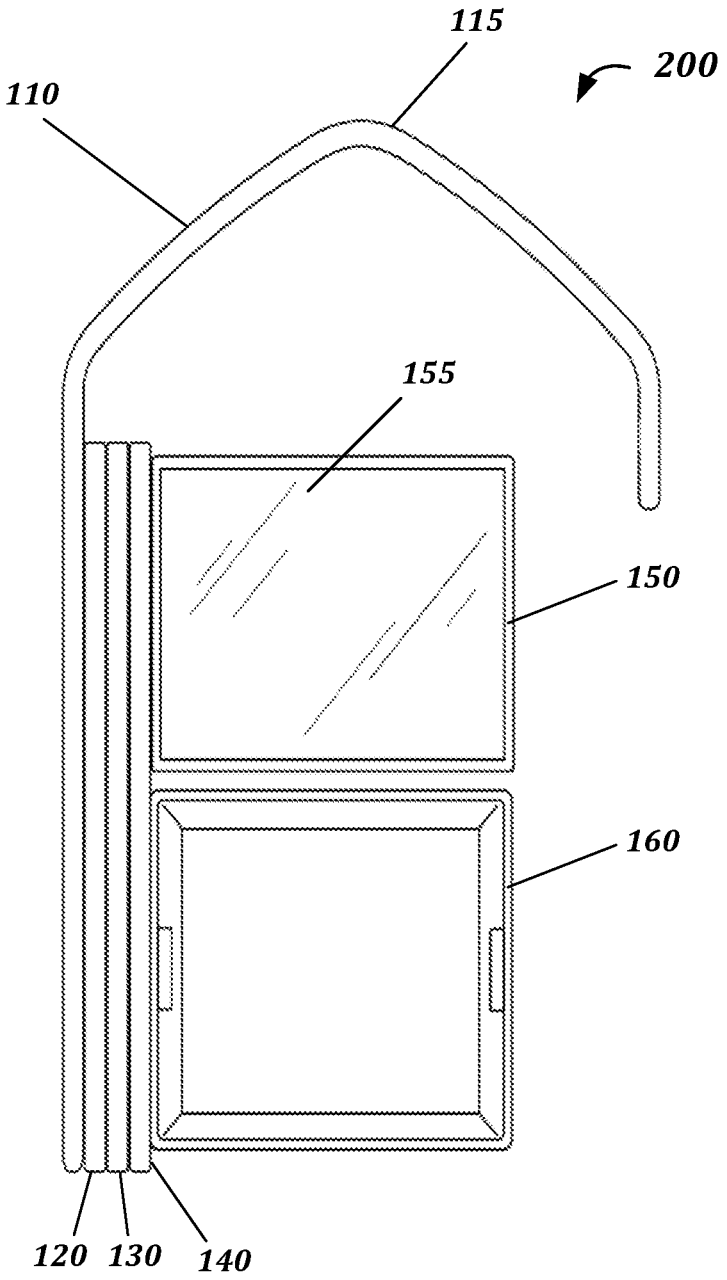
FIG. 2A depicts an example of the elements of the portable beauty tool assembly shown in FIG. 1 assembled in a collapsed orientation, and placed in a right-handed configuration, in accordance with an embodiment of the present disclosure.
Figure 2B:
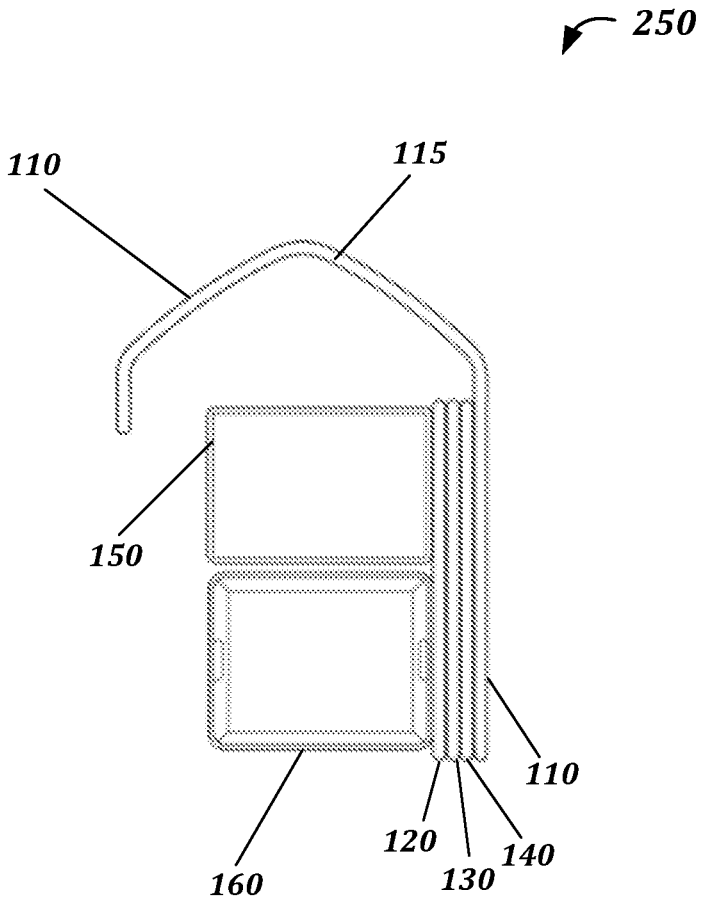
FIG. 2B depicts an example of the elements of the portable beauty tool assembly shown in FIG. 1 assembled in a collapsed orientation, and placed in a left-handed configuration, in accordance with an embodiment of the present disclosure.

FIG. 2A shows the portable beauty tool assembly 200 in a compact right-handed configuration. Alternatively, FIG. 2B shows the portable beauty tool assembly 250 in a compact left-handed configuration. For example, the illustrated example in FIG. 2A can be considered the assembly's 200 compact position (also referred to herein as the collapsed position) where all of the adjustable arms 120, 130, and 140 are retracted (as oppose to be extended) such that the arms are parallel to each other. Thus, the assembly 200 is positioned to have an area that takes up little space, by having the arms 120, 130, and 140 brought in, and the assembly's width being defined by its body (e.g., width of the mirror box 150, tray 160, and hook arm 110).

Also, as seen in FIG. 2A, the placement of the arms 120, 130, and 140 causes the assembly 200 to be offset from the center of the body. Such a configuration may provide for the right-handed orientation of the portable beauty tool assembly 200, shown in FIG. 2A. In the right-handed configuration, the end of the hook arm 110 is positioned to the right of the assembly's 200 body, allowing an "opening" (e.g., not including the arm) to the tray 160 and mirror box 150 to be placed near to the right hand of the user. In other words, when the right is the user's dominant hand, this arrangement allows the user to have access on the right-side of the assembly 200 without any obstruction.

FIG. 2B shows a left-handed configuration for the portable beauty tool assembly 250. As an opposite to the right-handed configuration, the end of the hook arm 110 is positioned to the left of the assembly's 250 body, where the "opening" is near the user's left hand. In some cases, changing from the right-handed configuration 200 in FIG. 2A to the left-handed configuration 250 in FIG. 2B (or vice versa), can comprises flipping the body of the assembly over and repositioning the other elements accordingly. Structuring the tool to support both a left-handed orientation and a right-handed orientation, the assembly can be completely ambidextrous and easy to use for wide range of users (e.g., left handed and right handed).

Figure 3:
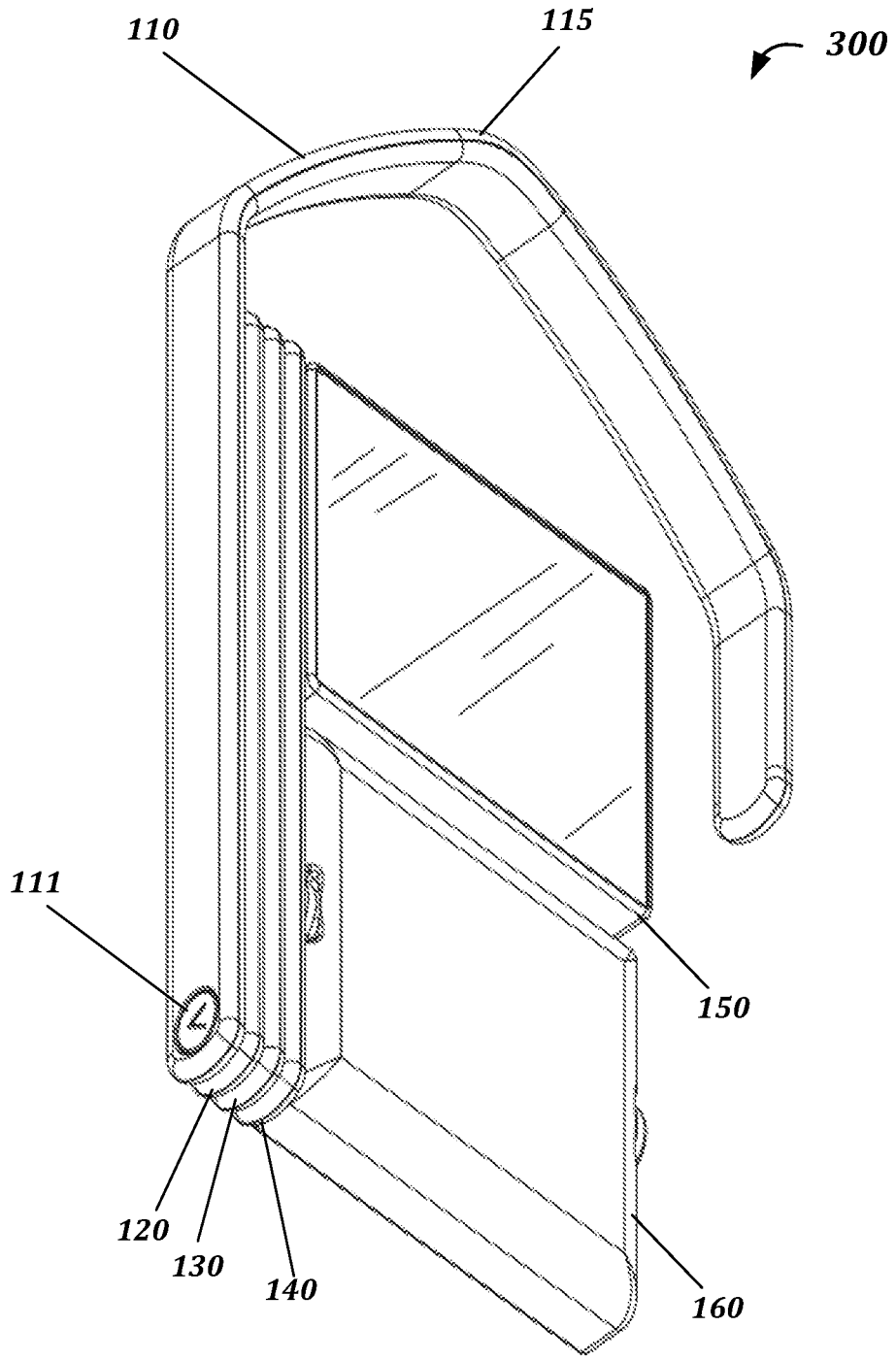
FIG. 3 depict a perspective view of an example of the portable beauty tool assembly, in accordance with an embodiment of the present disclosure.

Referring now to FIG. 3, a perspective view of the portable beauty tool assembly 300 in the compact position, or collapsed position, with the adjustable arms 120, 130, and 140 collapsed is shown. In some embodiments, when the assembly 300 is positioned in the manner depicted in FIG. 3, it can be used in the hanging functional position. That is, a mirror 155 of the assembly 300 can be placed to face towards an external surface of the tool's body, and presumably towards the face of user. Also, with all of the arms 120, 130, and 140 retracted in this compact position, the hook arm 110 can serve as a principal element to affix the assembly to a stationary surface, or object, by hanging. An example of the hanging functional position for the portable beauty tool assembly is illustrated, more prominently, in FIGS. 4A-4B.

Figure 4A:
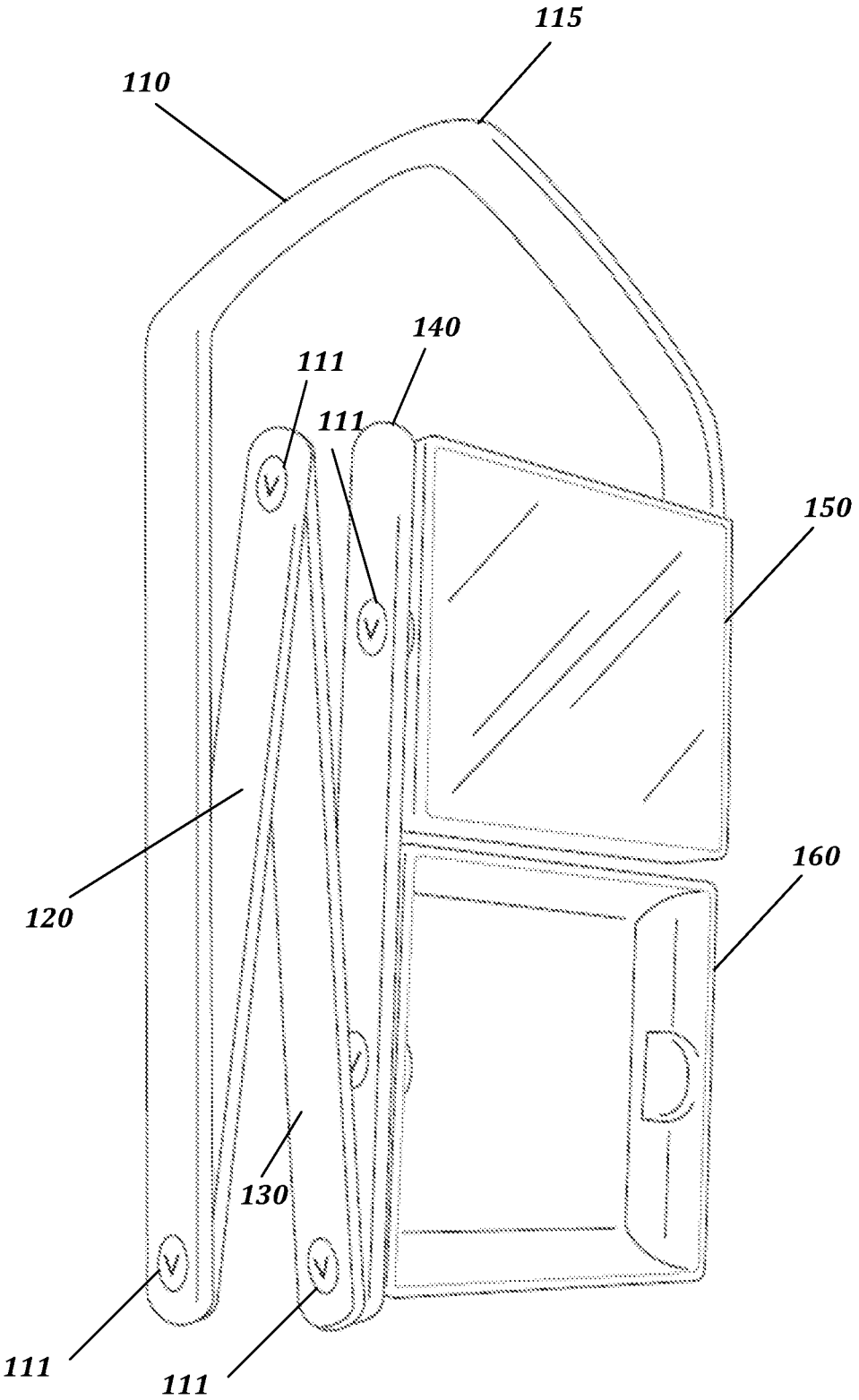
FIG. 4A depict an example of the portable beauty tool assembly arranged in an upright orientation for user in a vertical hanging functional position, in accordance with an embodiment of the present disclosure.

In FIG. 4A, the portable beauty tool assembly 400 is placed in an upright orientation, in order for it to be vertically hung from a flat surface. In such a configuration, the assembly 400 can provide the hands-free features. For instance, as illustrated, the assembly 400 may be a hands-free mirror that can be hung on a vertical surface. As alluded to above, the mirror 155 may be a double-sided mirror, where each side may have different magnification. For example, while vertically hung in this functional position, the mirror 155 can be positioned to the first side for having a close-up mirror providing greater magnification. The adjustable movement aspects of the assembly 400 allows the user to individually flip the mirror box 150 to a second side having a standard mirror providing standard magnification (as the body of the assembly 400 remains stably hung in its current position).

Figure 4B:
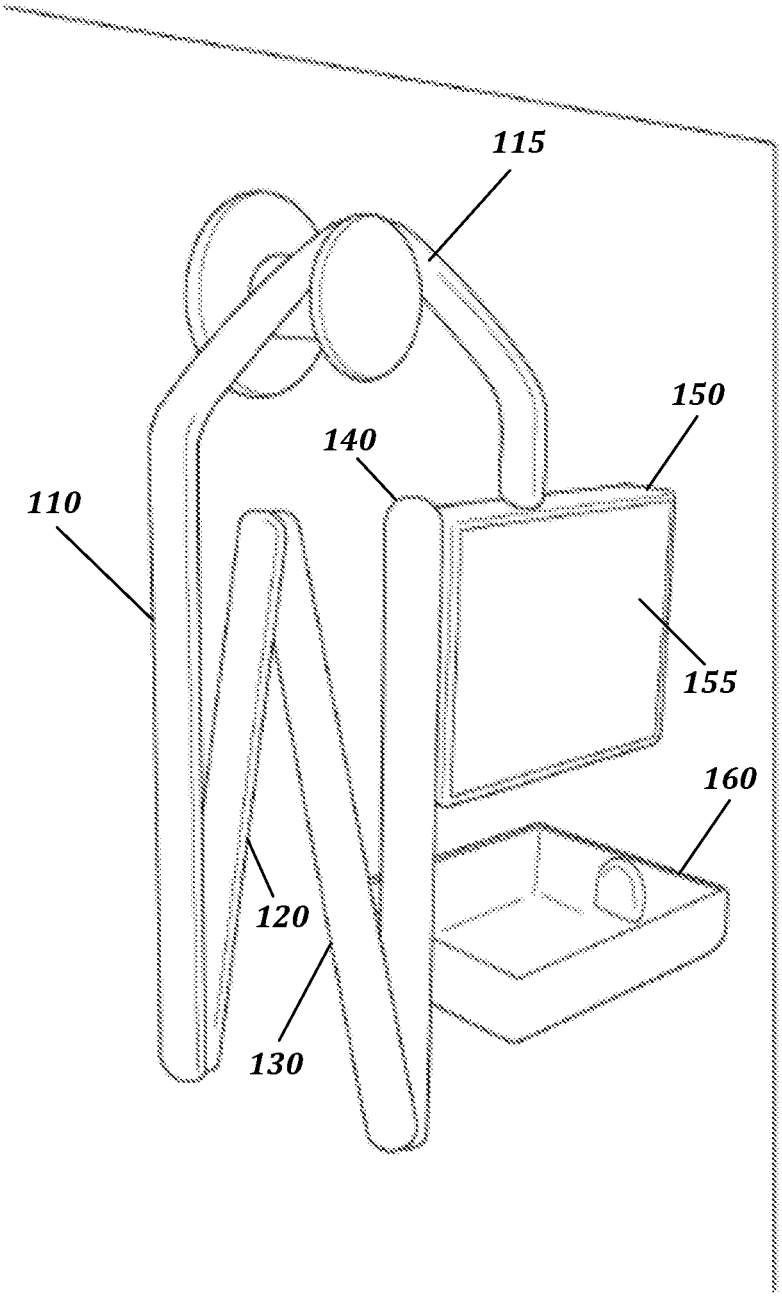
FIG. 4B depict another example of the portable beauty tool assembly arranged in an upright orientation for user in a vertical hanging functional position with a knob, in accordance with an embodiment of the present disclosure.

FIG. 4B shows an example of the portable beauty tool assembly 400 while being used in its hung functional position. The assembly 400 can be hung from a stationary object (e.g., door, wall) with the use of any protruding element, suitable for hold or hanging an item thereon, for instance a hook, knob, handle, and the like. In FIG. 4B, the assembly is being hung from a knob on a wall. By placing the hooked portion 115 of the hooking arm 110 on the hook at a particular angle, it allows for the rest of the weight of the assembly 400 (extending from the hook arm 110) to be balanced and rest stably on the surface of the door (e.g., without shaking or rocking).

Also, FIG. 4B illustrates that the adjustable arms 120, 130, and 140 can also be extended in the hanging functional position. This pushes the body of the assembly 400 slightly away from the surface of the door, allowing the hook arm 110 to rest directly on the surface of the door to keep the tool stable, while the assembly's body is positioned at a distance away from the door. The distance created by extending the arms 120, 130, 140 can be enough to allow the tray 160 to be adjustably moved to its flat, downright, or "open" position. In the configuration of FIG. 4B, the assembly 400 can be in its hanging functional position, and function as both a hands-free mirror and a cosmetics tray that holds additional items, allowing more freedom for the user.

Figure 5:
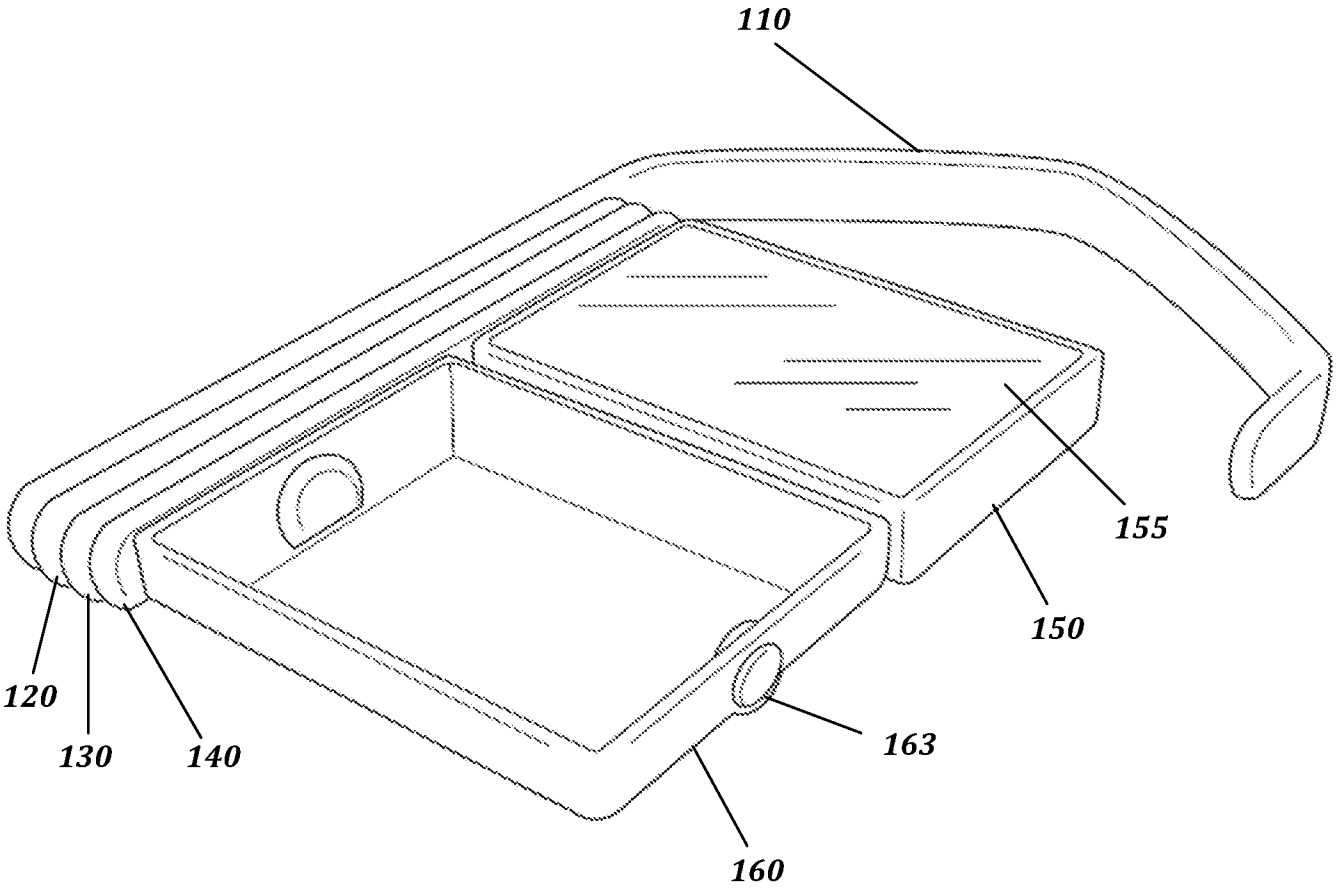
FIG. 5 depict an example of the portable beauty tool assembly arranged in a horizontally flat orientation for user in a tabletop functional position, in accordance with an embodiment of the present disclosure.

FIG. 5 shows the portable beauty tool assembly 500 in a compact configuration and resting horizontally, for example while being laid on a flat surface. As previously described, the assembly 500 can be adjusted to be compact and having all of its arms 120, 130, and 140 collapsed. This configuration places the assembly 400 in a substantially linear arrangement that is well suited for the tool to be set flat, for instance being placed on a tabletop (to be further moved into the tabletop functional position). Examples of the beauty tool assembly particularly arranged in the tabletop operational positional is depicted in detail in FIGS. 6A-6B.

Figure 6A:
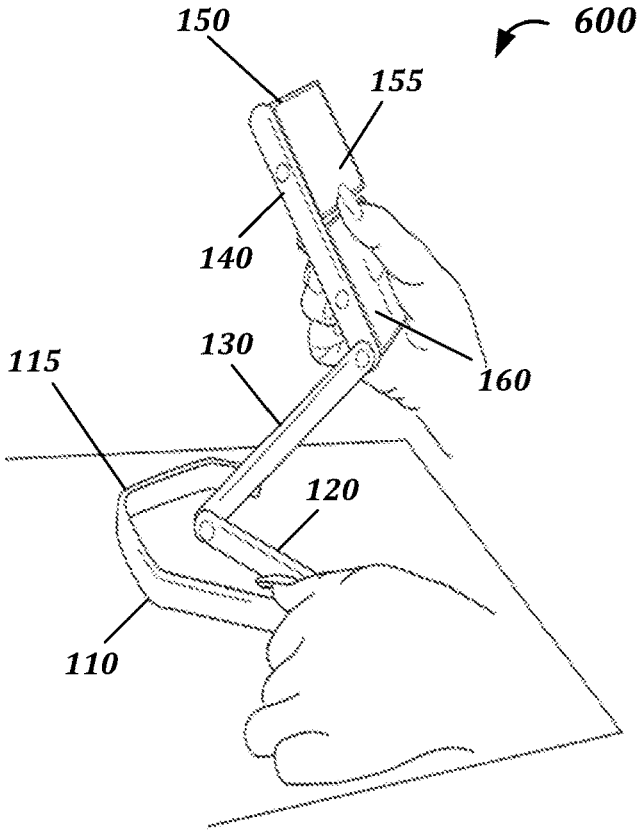
FIGS. 6A-6B depict examples of the portable beauty tool assembly arranged in an upright and extended orientation for user in a tabletop functional position, in accordance with an embodiment of the present disclosure.
Figure 6B:
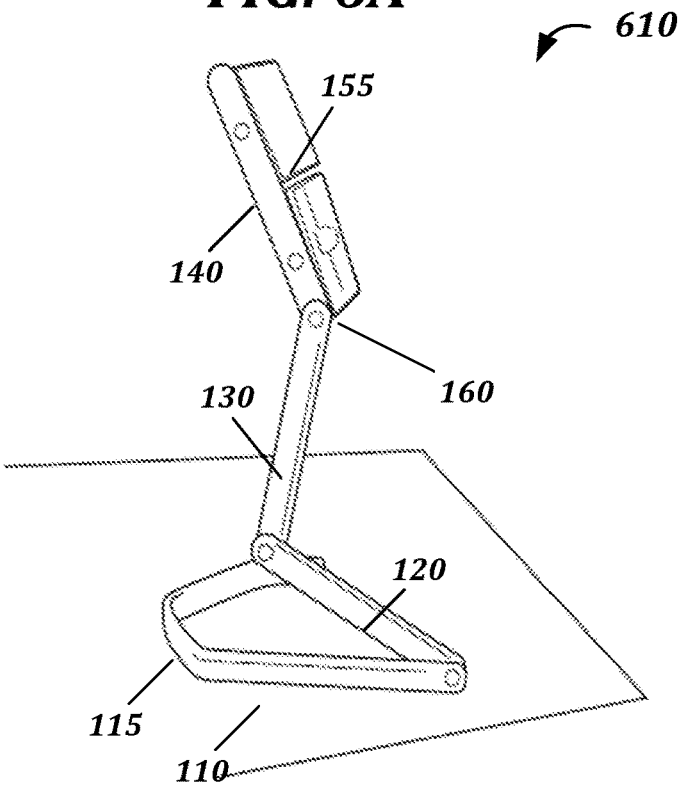

FIGS. 6A-6B illustrate examples of stages that may be involved in placing the portable beauty tool assembly 600 into the tabletop functional position. From a starting position where the assembly 600 is lying flat on a table (shown in FIG. 5), a portion of the assembly 600 (e.g., the mirror box 150) can be moved upward, causing the adjustable arms 120, 130, and 140 to also extend upwards. For example, a user can grab the mirror box 150 in their hand (and while holding the hook arm 110 firmly on the table) and move it to be brought up to an adjustable height as desired (e.g., eye level). The adjustable arms 120, 130, and 140 can move to various positions and extend to different levels, allowing the assembly 600 to be adjusted to multiple heights, for instance to a height while the user is seated, and to a different height while a user is standing.

FIG. 6B shows the portable beauty tool assembly 610, while is it fully extended (e.g., at the desired height) in the tabletop functional position. In this configuration, the hook arm 110 rests directly on the surface of the table. Having a curved and widened shape, the hook arm 110 can serve as a base that supports the weight of the assembly 610, while resting firmly on the table. In some cases, the assembly 100 can be specifically arranged to achieve optimal stability on the table in this functional position. For instance, by adjusting the arms 120, 130, and 140 such that an attachment point (coupling the middle adjusting arm 130 and hook adjustable arm 120) is positioned away from the user, and the middle adjustment arm 130 is arranged at a slight angle (e.g., slanted forward towards the user) can improve the assembly's 610 balance while positioned to be set on top of the table. Consequently, the assembly 610 can sit on the tabletop with enough stability to stand upright on its own, with the mirror 155 facing the user, for example.

Figure 7A:
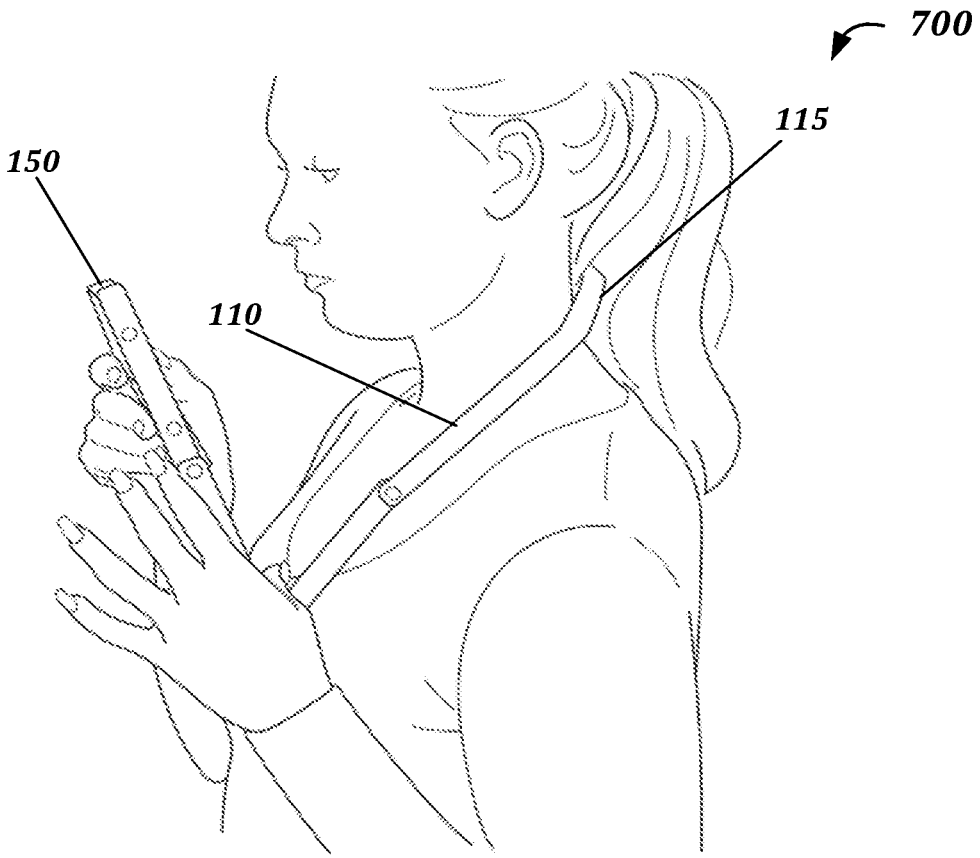
FIGS. 7A-7B depict examples of the portable beauty tool assembly arranged in an extended orientation for user in an around the neck functional position, in accordance with an embodiment of the present disclosure.
Figure 7B:
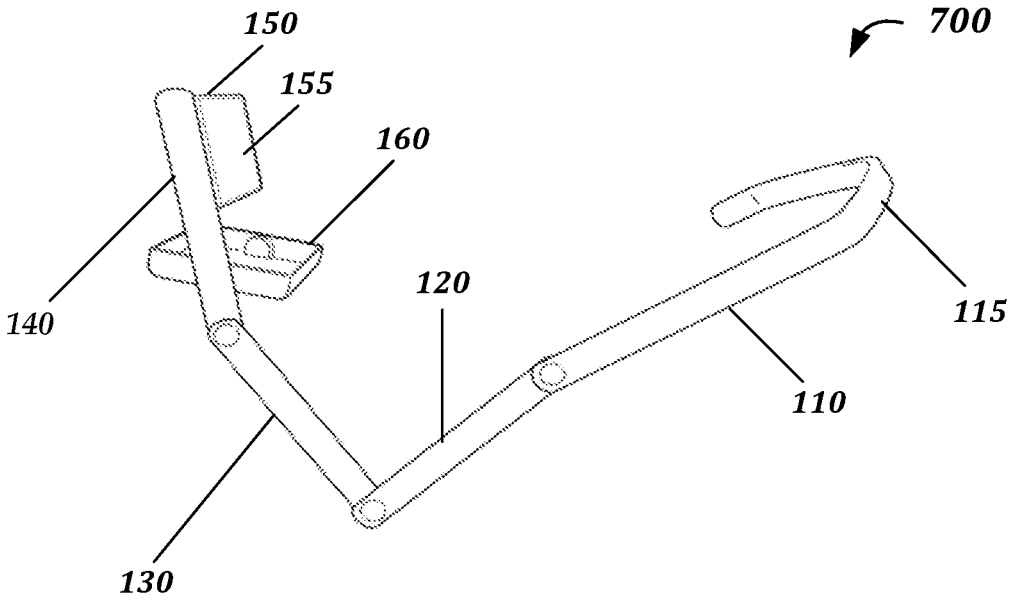

Another example of a functional position for the portable beauty tool assembly 700 is shown in FIGS. 7A-7B. In particular, the portable beauty tool assembly 700 is depicted in the neck functional position. Generally, in this functional position, the assembly 700 hangs down from around the neck of the user, and resting in in stable position on the user's chest that allows for hands-free use of the accessories. As seen in FIG. 7A, the hook arm 110 of the assembly 700 can be situated around the neck of the user, such that the curved portion of the hook arm 110 firmly sits along the neck's natural curve. Thus, the hook arm 110 can provide balance and stabilization for rest of the assembly 700 that extends from the arm, as it hangs down from the neckline. As the hook arm 110 rests against the back of the user's neck, the adjustable arm 120 which extends away from the hook in a linearly fashion (from one side of the hook arm 110) can lay flat against the collarbone and/or chest of the user. The middle adjustable arm 130 can be adjusted to extend upward and outwardly away from the user at angle, which arranges the mirror box 150 and tray 160 to further away from chest area and more proximal to the front of the user's face (e.g., eye level).

For arranging the portable beauty tool assembly 700 into the neck functional position, the assembly 700 can initially be in the right-handed position (shown in FIG. 2A). Then, by taking the mirror box 150 in one hand (e.g., right hand) and pulling the hook arm 110 forward with the other (e.g., left hand) the user can begin to extend the adjustable arms 120, 130, and 140 moving the assembly's 700 body away from the hook arm 110. Adjusting the assembly in this manner starts to create some distance between the hook arm 110 and the assembly's 700 body, which separates the hook arm 110 far enough away for placing it comfortably around the users' neck. Then, the user can bring the assembly 700 up to head region, placing the bent portion of the hook arm 110 behind the neck. The user can place a hand on attachment points (e.g., connecting the hook adjustable arm 120 to the middle adjustable arm 130) for rotating the accessories up to be in front of the user's face, for example.

Referring to FIG. 7B, the portable beauty tool assembly 700 is shown fully extend in the neck functional position. That is, the hook adjustable arm 120 is extended downward, with its length extending away from the hook arm 110, while the middle adjustable arm 130 is rotated in an upward position from the hook adjustable arm 120 (forming a "V" shape). Additionally, in this example, the tray 160 has been placed in its downright "open" position and the accessory adjustable arm 140 placed at an inclined angle which can tilt the attached mirror box 150 forward to be proximately closer to the user's face. It should be appreciated that the arrangement and heights for any of the adjustable arms 120, 130, 140 can be slightly different than the example shown in FIG. 7B in order to position the assembly 700 to suit the specific needs of the user (e.g., user neck size and/or length, user height, desirable area reflection, and the like).

Figure 8A:
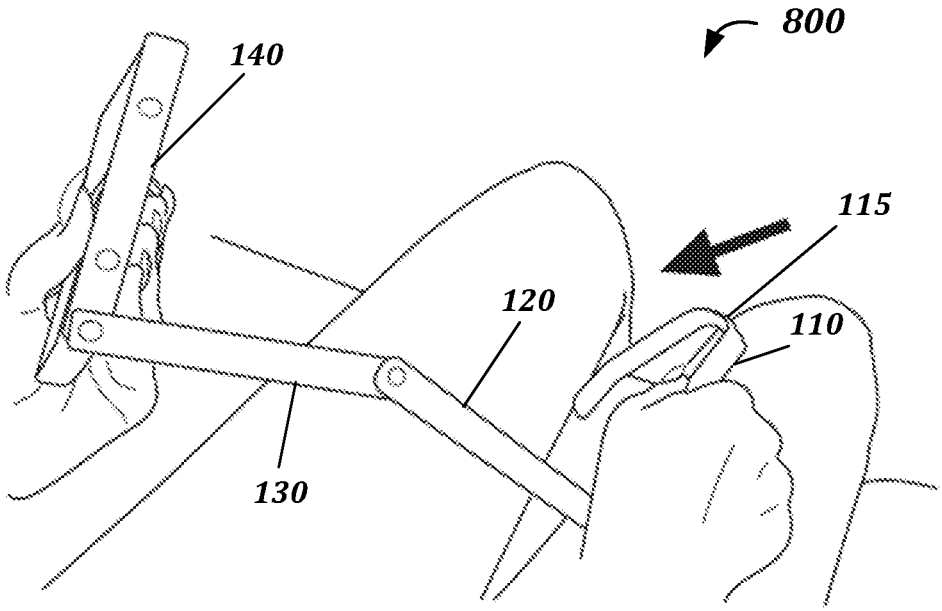
FIGS. 8A-8B depict examples of the portable beauty tool assembly arranged in an extended orientation for user in an under the leg functional position, in accordance with an embodiment of the present disclosure.
Figure 8B:
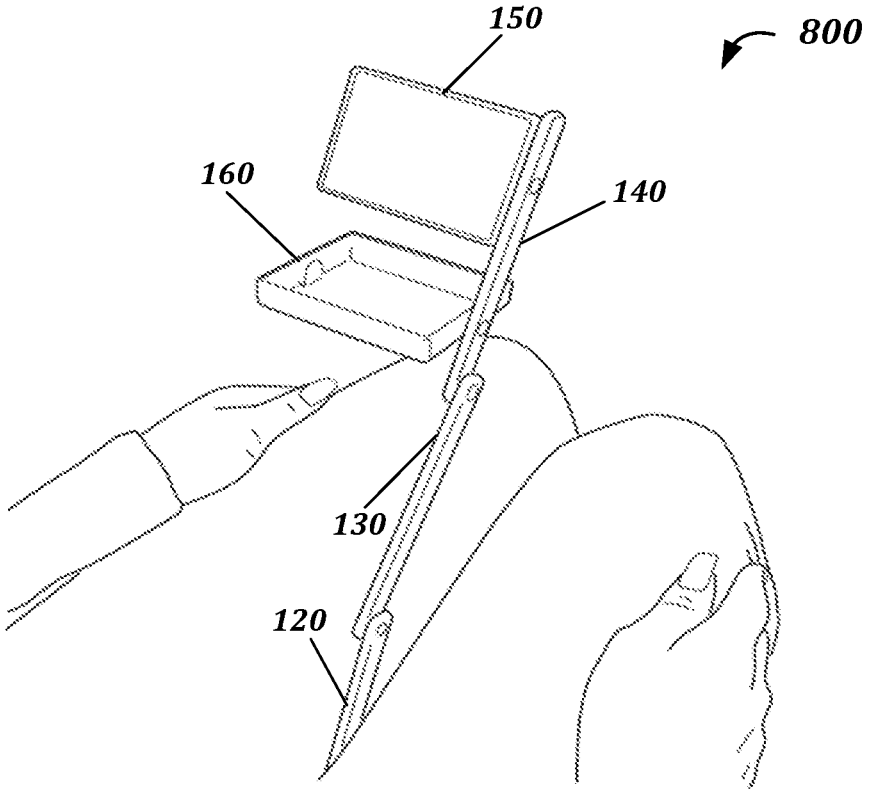

FIGS. 8A-8B shown the portable beauty tool assembly 800 in yet another functional position, where the assembly 800 is placed on the user's leg for hands-free use. FIG. 8A illustrates that the hook arm 110 can be lowered down for placing its curved portion around a leg, thigh, knee or other lower extremity of the user's body. From this lowered position, the hook adjustable arm 120 can be positioned upward, and the middle adjustable arm 130 can be extended further forward towards the user. This arrangement moves the assembly's 800 accessories up and away from the user's leg, in a manner that positions the mirror box 150, for example, closer to the face of the user (e.g., eye level), while the hook arm 110 is stably set around the users' leg.

FIG. 8B shows the assembly 800 in the leg functional position. In the illustrated example, the assembly 800 is in a fully extended position up from the leg, which is an arrangement that may be applied during use. As seen, the hook adjustable arm 120, the middle adjustable arm 130, and the accessory arm 140 are all positioned upward and extending out away from the users' leg (e.g., hook arm underneath of the leg is not shown). The arms 120, 130, 140 place the mirror box 150 and tray 160 at a height that is generally parallel to the user's face and arms for ease of hands-free use. For example, in the arrangement of FIG. 8B, the assembly 800 sits comfortably under the user's upper thigh, being held in place by the user's body weight. This allows the lower portion of the assembly 800 to remain stable, while the accessories can be adjusted to a height that is easily accessible to the user. Any items that are set in the tray 160 of the assembly 800 are within hand's reach of the user, and the mirror 155 can be angled to be used simultaneously.

To place the assembly 800 in the leg functional position of FIG. 8B, for example, the assembly can start in the left-handed position (shown in FIG. 2B). Then, the mirror box 150 and the tray 160 can be grabbed in one hand (e.g., left hand), and the opposite hand (e.g., right hand) can pull the hook arm 110 downwards. The hook arm 110 can be swept beneath the user's leg, being rested against a flat surface that the user is seated on, such as a chair. It should be apricated that the curved portion of the hook arm does not have to go around the leg, but can be kept flat against the seated surface using the weight of the user's leg to keep it stably in position. Then, the adjustable arms 120, 130, and 140 can be moved upward and outward to adjust the body of the assembly 800 the desired height and distance away from the face (e.g., based on user arm length, user height, and the like).

Figure 9A:
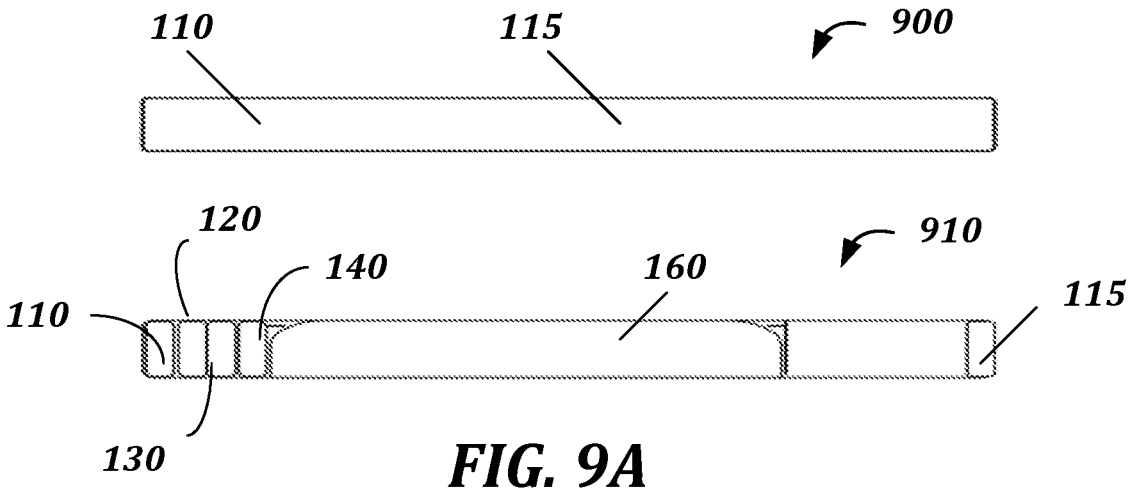
FIG. 9A-9B depict a top, bottom, and side views of an example of the portable beauty tool assembly, in accordance with an embodiment of the present disclosure.
Figure 9B:
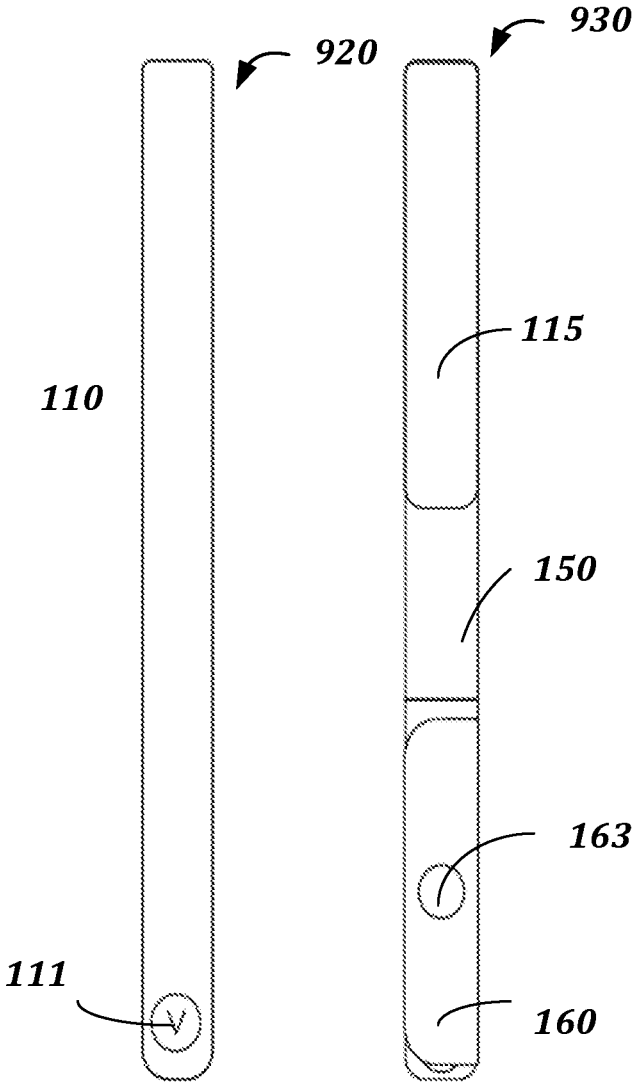

Now, referring to FIGS. 9A-9B, multiple different views of the portable beauty tool assembly is shown. In FIG. 9A, a top view of the assembly 900 is shown, and a bottom view of the assembly 910 is shown. In FIG. 9B, a left view of the assembly is shown 920 and a right view 930 of the assembly is shown. FIGS. 9A-9B illustrate the hooked portion 115, the hook arm 110, the adjustable arms 120, 130, and 140, the tray 160, the magnet 163, and the mirror box 150.

In some embodiments (not shown herein), the assembly 900 may comprise additional lighting. For example, the assembly 900 may be configured with a lighted mirror. In other embodiment, the assembly 900 may be configured with a camera. In yet another embodiment, the assembly 900 may be configured with one or more streaming devices (e.g., wireless processing device, laptop, smartphone, etc.) connected by one or more wireless networks to a cloud computing apparatus, server, computer, tablet, laptop, smartphone, device, electronic device or other apparatus. Wireless networks may include but not be limited to Bluetooth, Wi-Fi, ethernet, internet and the necessary components for facilitating said connections.

Based on the functions and configurations described herein, the portable beauty tool assembly 900 may be of use to travelers, airline passengers, campers outdoors or in tents, commuters on a metro train, subway, bus, or transit system. The assembly 900 may also be of use for users in a car, taxi, limousine, Uber, Lyft, or hired vehicle. Additionally, the assembly 900 is not restricted to cosmetics, and may be of use for males and females, for examples while applying, dermatology applications to the skin. The assembly 900 may be used by persons needing a portable hands-free mirror for use with their dental hygiene, facial grooming, managing contact lenses, shaving, and the likeness thereof. Moreover, the assembly 900 may transform any room, office, hotel room, or other location into a perfect place to apply cosmetics using natural light. The assembly 900 also serves many simple functions, for instance being used by anyone who uses a mirror, or may be used by anyone who would like to use natural lighting to apply makeup.

In other embodiments, the assembly 900 may use enhanced lighting, powered illumination, and powered lighting systems including LEDs in addition to natural lighting.

The assembly 900 may be suitable for many wearers, including but not limited to competitive dance teams, cheerleaders, beauty pageant participants, military personnel. The assembly 900 may be used for convenience for persons in wheelchairs, hospital patients, nursing home residents, assisted living residents, and/or bedridden individuals. In other instances, the assembly 900 may also find use amongst those having careers which provide them with little time few places to effectively apply cosmetics (i.e., flight attendants, new mothers, etc.).

As alluded to above, the portable beauty tool assembly 900 solves many of the problems and challenges from the prior art. For example, the assembly 900 of the present disclosure eliminates the need to ever hold a compact while applying makeup. In addition, the assembly 900 eliminates the need to be in a bathroom to apply cosmetics, contact lens, and the likeness thereof. The assembly 900 can eliminate the need to have a flat, stable surface to rest a cosmetic mirror upon, and even addresses the challenge of keeping track of small cosmetic items in an effort to prevent them being misplaced or dropped. In accordance with the embodiments, the assembly 900 may address the problem of not having enough natural light at a fixed mirror location, by providing portability that allows a user to go to the light (or use installed light on the assembly 900) instead of hoping the interior space has sufficient lighting for effective cosmetic application.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description. It is to be understood that both the foregoing description are and explanatory only and are not restrictive of the disclosure, as claimed. While the present disclosure may relate to cosmetic uses of the mirror and assembly 900, there may be other suitable uses and contexts (i.e., for medical uses, for dental uses, for grooming uses, and the likeness thereof).

Figure 10:
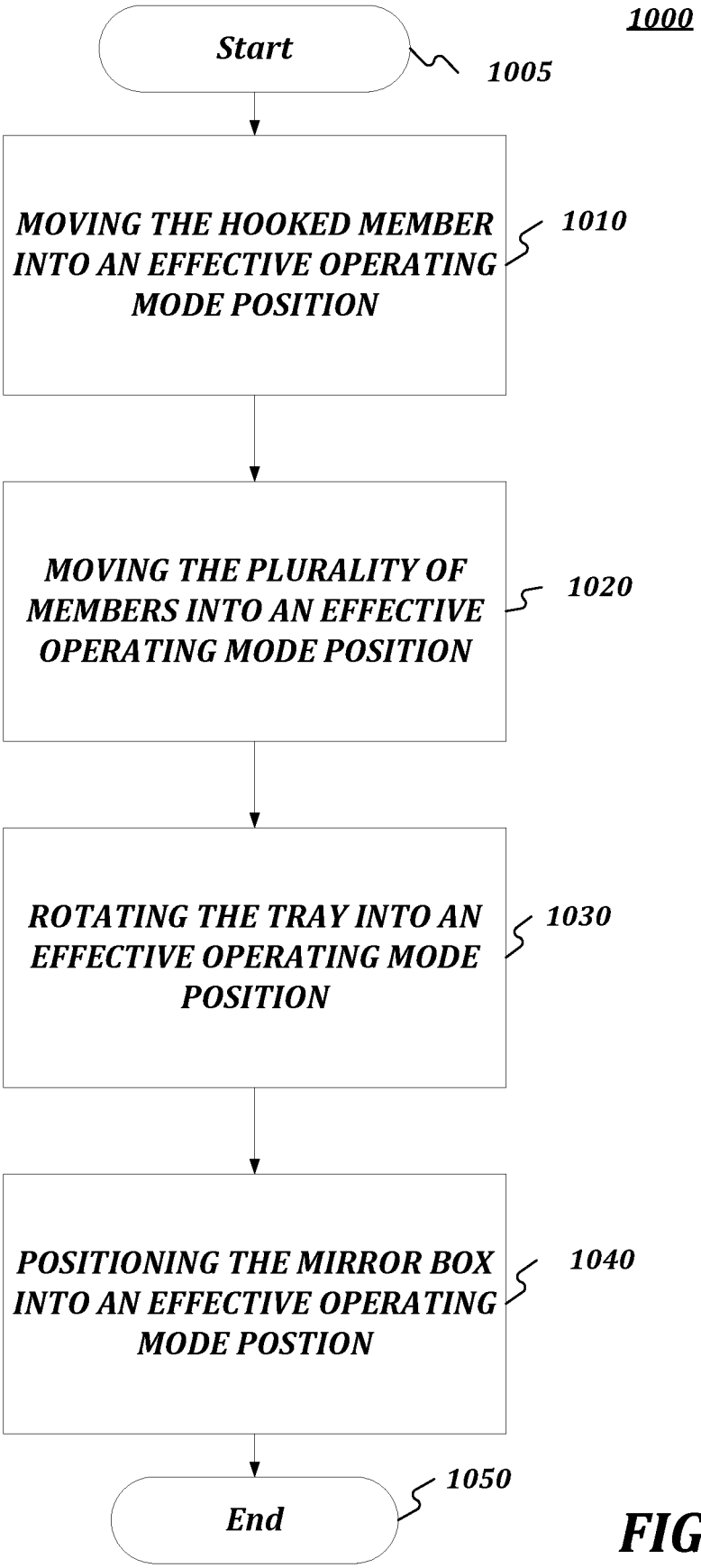
FIG. 10 is a flow chart of a method for providing the portable beauty tool assembly, in accordance with an embodiment of the present disclosure.

FIG. 10 is a flow chart setting forth the general stages involved in a method 1000 consistent with an embodiment of the disclosure for providing the portable beauty tool assembly disclosed herein. Method 1000 may be implemented using the portable beauty tool apparatus as described in more detail below with respect to FIG. 10.

Although the stages illustrated by the flow charts are disclosed in a particular order, it should be understood that the order is disclosed for illustrative purposes only. Stages may be combined, separated, reordered, and various intermediary stages may exist. Accordingly, it should be understood that the various stages illustrated within the flow chart may be, in various embodiments, performed in arrangements that differ from the ones illustrated. Moreover, various stages may be added or removed from the flow charts without altering or deterring from the fundamental scope of the depicted methods and systems disclosed herein. Ways to implement the stages of method 1000 will be described in greater detail below.

Method 1000 may begin at starting block 1005 and proceed to stage 1010 where the assembly may be manipulated to move a hooked member into an effective operating mode position. For example, moving a hooked member so that it firmly rests on a level base for an effective operating mode such as the sitting position. In another instance, the hooked member may be appropriately positioned on a hanging means for an effective operating mode such as a hanging position. In other instances, the hooked member may be positioned around the neck of a user for an effective operating mode such as a wearing position. In yet further instances, the hooked member may be placed in a stationary position for an effective operating mode such as the collapsed or starting position.

From stage 1010, where the assembly may be moved such that a hooked member has been moved into an effective operating mode position, method 1000 may advance to stage 1020 where the assembly may be manipulated such that a plurality of members may be moved into an effective operating mode position. For example, raising a first and second member to an elevated angle; positioning a third member at an angle appropriate to a height of a user for an effective operating mode such as the sitting position. In another instance, raising a first and second member to a first and second angle; positioning a third member at an angle appropriate to a height of a user for an effective operating mode such as the hanging position. In a further instance, raising a first and second member to a first and second angle appropriate to a user's body; and positioning a third member at an angle appropriate to a height of a user for an effective operating mode such as the wearing position. In yet another instance, aligning a first, second and third member with a stationary position for an effective operating mode such as the collapsed or starting position.

Once the assembly may be manipulated such that a plurality of members may be moved into an effective operating mode position in stage 1020, method 1000 may continue to stage 1030 where the assembly may rotate a container at an effective operating mode position. For example, rotating the container such that it may hold cosmetics and cosmetic accessories for at least one of: a sitting position, a hanging position, a wearing position, and a collapsed position.

After the assembly rotates a container at an effective operating mode position in stage 1030, method 1000 may proceed to stage 1040 where the assembly may be manipulated by positioning a mirror at an effective operating mode position. For example, positioning a mirror at an effective operating mode position for at least one of: a sitting position, a hanging position, a wearing position, and a collapsed position. Once the assembly may be manipulated by positioning a mirror at an effective operating mode position in stage 1040, method 1000 may then end at stage 1050

ASPECTS

The following discloses various aspects of the present disclosure. The various Aspects are not to be construed as patent claims unless the language of the Aspect appears as a patent claim. The Aspects describe various non-limiting embodiments of the present disclosure.

The following discloses various aspects of the present disclosure. The various Aspects are not to be construed as patent claims unless the language of the Aspect appears as a patent claim. The Aspects describe various non-limiting embodiments of the present disclosure.

Aspect 1: An apparatus, comprising:

a hooked member having an extended portion and a hooked portion; a plurality of adjustable members, each adjustable member being movably attached to at least one other adjustable members at an attachment point and at least one adjustable member and the hooked member being movably attached to one another at an attachment point; and a plurality of accessories, each accessory being movably attached to at least one adjustable member;

wherein each attachment point defines an axis of rotation; and wherein the hooked member and plurality of adjustable members are each configured to move about at least one axis defined by an attachment point.

Aspect 2: The apparatus of aspect 1, wherein the plurality of accessories comprise a mirror assembly comprising an enclosing frame having a first mirror disposed on a front surface of the enclosing frame and a second mirror disposed on a rear surface of the enclosing frame; and a receptacle having a flat base and four sides that define a cavity for receiving and releasably containing contents therein.

Aspect 3: The apparatus of any preceding aspect, wherein each attachment point defines an axis of rotation or pivot.

Aspect 4: The apparatus of any preceding aspect, wherein at least one adjustable member is movable attached to two other adjustable members.

Aspect 5: The apparatus of any preceding aspect, wherein each of the hooked member and adjustable members comprise at least one attachment point.

Aspect 6: The apparatus of any preceding aspect, wherein at least one adjustable member comprises two or more attachment points.

Aspect 7: The apparatus of any preceding aspect, wherein each of the hooked member and adjustable members are configured to attach at one or more attachment points using a connecting component or connecting means.

Aspect 8: The apparatus of any preceding aspect, wherein each of the hooked member and adjustable members are configured to cooperatively move about one or more attachment point into a plurality of predetermined positions and predetermined configurations.

Aspect 9: The apparatus of any preceding aspect, wherein the hooked member in a first configuration is effective to be used to hang the apparatus and in a second configuration is effective to be used as a base support to hold up the apparatus when place on the ground Aspect 10: The apparatus of any preceding aspect, wherein the apparatus is collapsible and expandable.

Aspect 11: The apparatus of any preceding aspect, wherein the apparatus comprises a collapsed state and expanded state.

Aspect 12: The apparatus of any preceding aspect, wherein in the collapsed state, the hooked member, adjustable members, and plurality of accessories are configured to lay flat long the same or substantially same planar axis.

Aspect 13: The apparatus of any preceding aspect, wherein in the collapsed or nested state, the extended portion of the hooked member and all adjustable members are parallel and adjacent to one another.

Aspect 14: The apparatus of any preceding aspect, wherein the first and third attachment point are aligned along the same axis Aspect 15: The apparatus of any preceding aspect, wherein each of the hooked member and plurality of adjustable members are configured to be moved from 1 to 360 degrees about one or more attachment points; wherein each degree corresponds to a predetermined position.

Aspect 16: The apparatus of any preceding aspect, wherein the plurality of adjustable members comprise a first adjustable member having first and second opposed ends, a second adjustable member having first and second opposed ends, and a third adjustable member having first and second opposed ends; the first end of the first adjustable member being movably attached to the extended portion of the hooked member at an end distal to the hooked portion, and the second end of the first adjustable member being movably attached to the first end of the second adjustable member; the second end of the second adjustable member being movably attached to the first end of the third adjustable member; and the third adjustable member being movably attached to the mirror assembly and receptacle.

Aspect 17: The apparatus of any preceding aspect, wherein the plurality of adjustable members comprise: a first adjustable member having first and second opposed ends, a second adjustable member having first and second opposed ends, and a third adjustable member having first and second opposed ends; the first end of the first adjustable member being movably attached at a first attachment point to the extended portion of the hooked member at an end distal to the hooked portion, and the second end of the first adjustable member being movably attached at a second attachment point to the first end of the second adjustable member; the second end of the second adjustable member being movably attached at a third attachment point to the first end of the third adjustable member; and the third adjustable member being movably attached at fourth attachment point to the mirror assembly and at a fifth attachment point to the receptacle.

Aspect 18: The apparatus of any preceding aspect, wherein the third adjustable member being movably attached at fourth attachment point to the mirror assembly at a middle portion of the third adjustable member and at a fifth attachment point to the receptacle at a middle portion of the third adjustable member.

Aspect 19: The apparatus of any preceding aspect, wherein the mirror assembly is configured to rotate 360 degrees about the attachment point to which it is connected.

Aspect 20: The apparatus of any preceding aspect, wherein the receptable is configured to rotate 360 degrees about the attachment point to which it is connected.

Aspect 21: The apparatus of any preceding aspect, wherein the adjustable movement imparted by each of the plurality of adjustable members comprises: expanding, collapsing, and rotating.

Aspect 22: The apparatus of any preceding aspect, wherein each of the plurality of adjustable members can be adjustable moved for expanding by extending each of the plurality of members outward and away from the hooked member.

Aspect 23: The apparatus of any preceding aspect, wherein fully expanding each of the plurality of adjustable members adjusts the dimensions and position of the assembly to an increased height and width, positions the plurality of adjustable members to extend away from each other sequentially to form a linearly extended arm, and positions the plurality of accessories to a specific height with respect to a user.

Aspect 24: The apparatus of any preceding aspect, wherein each of the plurality of adjustable members can be adjustably moved for collapsing by retracting each of the plurality of members inward and towards the hooked member.

Aspect 25: The apparatus of any preceding aspect, wherein fully collapsing each of the plurality of adjustable members adjusts the dimensions and position of the assembly to a decreased height and width, and positions the plurality of adjustable members parallel to each other.

Aspect 26: The apparatus of any preceding aspect, wherein an opened end of the hooked portion can be oriented to the right of the mirror assembly and the receptacle forming a right-handed configuration for the assembly.

Aspect 27: The apparatus of any preceding aspect, wherein an opened end of the hooked portion can be oriented to the left of the mirror assembly and the receptacle forming a left-handed configuration for the assembly.

Aspect 28: The apparatus of any preceding aspect, wherein the hook member can stably orient the apparatus for hands-free use by positioning the hooked portion of the hook member around a neck of user.

Aspect 29: The apparatus of any preceding aspect, wherein arranging the hooked portion of the hook member around the neck of the user positions at least one of the plurality of adjustable arms to rest stably on a chest area or upper collar bone of the user, and positions at least one of the plurality of adjustable arms to extend sufficiently upward and rotate the plurality of accessories to thereby elevate the plurality of accessories at an angle and spatial location in front of the user to orient the plurality of accessories to a specific height effective to allow the user to view and access the plurality of accessories.

Aspect 30: The apparatus of any preceding aspect, wherein at least one predetermined configuration of the apparatus comprises arranging the hooked portion of the hook member around the neck of the user, positioning a first adjustable arms to rest stably on a chest area or upper collar bone of the user, and positioning the second adjustable arms to extend sufficiently upward and rotating the plurality of accessories to thereby elevate the plurality of accessories at an angle and spatial location in front of the user to orient the plurality of accessories to a specific height effective to allow the user to view and access the plurality of accessories.

Aspect 31: The apparatus of any preceding aspect, wherein the second adjustable arms to extend sufficiently upward to create an angle of from about 20 to 120 degrees is form between the first and second adjustable arms.

Aspect 32: The apparatus of any preceding aspect, wherein the hook member can stably orient the apparatus for hands-free use by positioned the curved portion of the hook member around a peg, knob, or other protruding element.

Aspect 33: The apparatus of any preceding aspect, wherein arranging the curved portion of the hook member around the protruding element of a stationary surface user positions the plurality of accessories to hang down vertically from the protruding portion such that a surface of the plurality of accessories is aligned parallel to a vertical surface of the stationary surface.

Aspect 34: The apparatus of any preceding aspect, wherein the hook member can stably position the apparatus for use by arranging the hook member in a horizontally flat position against a stationary surface.

Aspect 35: The apparatus of any preceding aspect, wherein arranging the hook member in a horizontally flat position against a stationary surface positions the hooked portion of the hook member to form a base effective to provide balance and support for orienting the assembly for hands-free use.

Aspect 36: The apparatus of any preceding aspect, wherein arranging the hook member in a horizontally flat position against the stationary surface positions at least one of the plurality of adjustable arms to extend upward from the stationary surface for elevating the plurality of accessories to a specific height with respect to a user.

Aspect 37: The apparatus of any preceding aspect, wherein the hook member can stably orient the apparatus for hand-free use by positioning the hooked portion underneath a leg of the user.

Aspect 38: The apparatus of any preceding aspect, wherein arranging the hook member underneath the leg of the user positions the hooked portion of the hook member to sit firmly between the leg of the user and a stationary surface providing balanced and stabilized support for the assembly.

Aspect 39: The apparatus of any preceding aspect, wherein arranging the hook member underneath the leg of the user positions at least one of the plurality of adjustable arms to extend upward from the stationary surface for elevating the plurality of accessories to a specific height with respect to a user.

Aspect 40: The apparatus of any preceding aspect, wherein a second configuration of the apparatus comprises arranging the hook member underneath the leg of the user, positioning first and second adjustable arms to extend upward, and rotating the plurality of accessories to thereby elevate the plurality of accessories at an angle and spatial location in front of the user to orient the plurality of accessories to a specific height effective to allow the user to view and access the plurality of accessories.

Aspect 41: The apparatus of any preceding aspect, wherein the hooked member is an elongated and linearly shaped bar.

Aspect 42: The apparatus of any preceding aspect, wherein adjustable members are elongated and linearly shaped bars.

Aspect 43: The apparatus of any preceding aspect, wherein each of the plurality of adjustable members are configured to impart adjustable movement that allows for dimensions and position of the apparatus to be adjustably changed; and wherein the plurality of accessories can be positioned based on the movement of the plurality of the adjustable members.

Aspect 44: The apparatus of any preceding aspect, further comprising at least one securing means configured to releasably secure contents within the receptacle.

Aspect 45: The apparatus of any preceding aspect, wherein the at least one securing means comprises a magnet and corresponding magnetic element, the magnet being configured to magnetically couple with the corresponding magnetic element within the contents.

Aspect 46: The apparatus of any preceding aspect, wherein at least a portion of the securing means may be disposed within the receptacle or a housing of the receptacle.

Aspect 47: The apparatus of any preceding aspect, wherein the magnet may be disposed within a groove on the outside of the receptacle, and the corresponding magnetic element is disposed on a surface of an insert sized and dimension to fit within the receptacle.

Aspect 48: The apparatus of any preceding aspect, wherein the insert may comprise a cosmetic tray insert or the like.

Aspect 49: The apparatus of any preceding aspect, wherein the magnetic element may comprise a metal plate, or other magnetic plate.

Aspect 50: The apparatus of any preceding aspect, wherein the cosmetic tray insert comprises a groove corresponding to the size and location of the magnet of the receptacle.

Aspect 51: A method comprising:

moving a hooked member into an effective operating mode position; moving a plurality of adjustable members into an effective operating mode position; and rotating at least one of more accessories attached to the hooked member and the plurality of adjustable arms into an effective operating mode position.

Aspect 52: The method of any preceding aspect, wherein an effective operating mode position further comprises at least one of: a leg position, a hanging position, a neck position, a tabletop position, and a collapsed position.

Aspect 53: The method of any preceding aspect, wherein rotating at least one of more accessories comprises rotating a receptacle having at last one flat surface forming a receptacle base for items to be stably placed upon.

Aspect 54: The method of any preceding aspect, wherein rotating at least one of more accessories comprises rotating a mirror assembly, wherein the mirror assembly is an enclosing frame having a mirror disposed therein forming a front surface of the mirror assembly and an additional mirror disposed therein forming a bottom (should this be back instead of bottom?) surface of the mirror assembly.

Aspect 55: A method of positioning an apparatus for use, the method comprising: positioning a surface of the apparatus to be aligned horizontally against a horizontally flat stationary surface; and adjustably moving a member of the apparatus to extend upward to an elevated and vertically increased angle with respect to the flat stationary surface.

Aspect 56: The method of any preceding aspect, wherein positioning a surface of the apparatus comprises placing a hook member stably against the flat stationary surface for providing stabilized and balanced support for the apparatus while in use.

Aspect 57: The method of any preceding aspect, further comprising: adjustably moving another member of the apparatus to extend upward to an elevated and vertically increased angle with respect to the flat stationary surface such that a plurality of accessories attached to the apparatus are positioned as a specific height with respect to horizontally flat stationary surface.

Aspect 58: The method of any preceding aspect, further comprising: adjustably rotating the plurality of accessories attached to the apparatus for positioning the plurality of accessories in a specific direction towards a user.

Aspect 59: The method of any preceding aspect, further comprising: adjustably rotating a receptacle of the plurality of accessories for positioning at least one flat surface of the receptacle to be horizontally parallel to the horizontally flat stationary surface and forming a stable base of the receptacle for items to be stably placed upon.

Aspect 60: A method of positioning an apparatus for use, the method comprising: adjustably moving a hook member of the apparatus to extend downwards to a declined and vertically lower angle with respect to a body of the apparatus; and positioning the hook member of the apparatus to be underneath a leg of a user.

Aspect 61: The method of any preceding aspect, wherein positioning the hook member of the apparatus underneath a leg of a user comprises placing the hook member stably against a flat stationary surface that is underneath the leg of the user for providing stabilized and balanced support for the apparatus while in use.

Aspect 62: The method of any preceding aspect, further comprising: adjustably moving another member of the apparatus to extend upward to an elevated and vertically increased angle with respect to the leg of the user such that a plurality of accessories attached to the apparatus are positioned at a specific height with respect to the user.

Aspect 63: The method of any preceding aspect, wherein positioning the hook member of the apparatus underneath a leg of a user comprises rotating the hook member.

Aspect 64: The method of any preceding aspect, further comprising: adjustably rotating a receptacle of the plurality of accessories for positioning at least one flat surface of the receptacle to be horizontally parallel to the leg of the user and forming a stable base of the receptacle for items to be stably placed upon.

Aspect 65: A method of positioning an apparatus for use, the method comprising: adjustably moving a hook member of the apparatus to extend outwards in a direction away from a body of the apparatus and towards a neck of a user; and positioning a hook member of the apparatus around the neck of the user.

Aspect 66: The method of any preceding aspect, further comprising: adjustably moving another member of the apparatus to extend outward in a direction away from the body of the apparatus and towards the neck of the user such that a specific distance for spacing is created between neck of the user and the body of the apparatus.

Aspect 67: The method of any preceding aspect, further comprising: adjustably rotating a plurality of accessories attached to the apparatus in an upward direction towards the user for positioning the plurality of accessories at a specific height with respect to the user.

Aspect 68: A method of positioning an apparatus for use, the method comprising: adjustably moving at least one member of the apparatus to extend outwards in a direction away from a body of the apparatus; positioning a hook member of the apparatus to be aligned vertically against a vertically flat stationary surface; and positioning the hook member of the apparatus around a protruding portion of the vertically flat stationary surface.

Aspect 69: The method of any preceding aspect, wherein positioning the hook member of the apparatus around the protruding portion of the vertically flat stationary surface comprises placing the hook member stably against the vertically flat stationary surface for providing stabilized and balanced support for the apparatus while in use.

Aspect 70: The method of any preceding aspect, wherein the protruding portion of the vertically flat stationary surface comprises a knob, a hook, or a handle.

Aspect 71: A mirror assembly apparatus comprising: at least one mirror; a container; a hooked member having an elongated member base portion and a hooked head portion; and a plurality of elongated members, including a first elongated member connected to the elongated member base portion of the hooked member at one end and an elongated member at its opposite end, wherein a last elongated member is connected to the elongated member at one end and the container and at least one mirror at its opposite end.

Aspect 72: A collapsible mirror apparatus, the apparatus comprising: at least one mirror; a container; a hooked member having an elongated member base portion and a hooked head portion; a plurality of elongated members, including a first elongated member connected to the elongated member base portion of the hooked member at one end and an elongated member at its opposite end, wherein a last elongated member is connected to the elongated member at one end and the container and at least one mirror at its opposite end; and wherein the collapsible mirror apparatus is configured to operate in at least one of: a sitting position, a hanging position, a wearing position, and a collapsed position.

Aspect 73: A method comprising: moving a hooked member into an effective operating mode position; moving a plurality of members into an effective operating mode position; rotating a container at an effective operating mode position; and positioning a mirror at an effective operating mode position.

Aspect 74: The method of any preceding aspect, wherein an effective operating mode position further comprises at least one of: a sitting position, a hanging position, a wearing position, and a collapsed position.

Aspect 75: A method of positioning a collapsible mirror apparatus, the method comprising: placing a hooked member firmly on a level base; raising a first member to an elevated angle; raising a second member to an elevated angle; positioning a third member at an angle appropriate to a height of a user; rotating a container to a desired angle; and rotating a mirror to an angle appropriate to the height of the user.

Aspect 76: A method of positioning a collapsible mirror apparatus, the method comprising: placing a hooked member on a hanging means; raising a first member to a first angle; raising a second member to a second angle; positioning a third member at an angle appropriate to a height of a user; rotating a container to a desired angle; and rotating a mirror to an angle appropriate to the height of the user.

Aspect 77: A method of positioning a collapsible mirror apparatus, the method comprising: placing a hooked member around the neck of a user; raising a first member to a first angle appropriate to a user's body; raising a second member to a second angle appropriate to a user's body; positioning a third member at an angle appropriate to a height of a user; rotating a container to a desired angle; and rotating a mirror to an angle appropriate to the height of the user.

Aspect 78: A method of positioning a collapsible mirror apparatus, the method comprising: placing a hooked member at a stationary position; aligning a first member with the stationary position; aligning a second member with the stationary position; aligning a third member with the stationary position; rotating a container to the stationary position; and rotating a mirror to the stationary position.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

The invention claimed is:

1. An apparatus, comprising:

a hooked member, wherein the hooked member is an elongated and linearly shaped bar having an extended portion and a curved hooked portion;

a plurality of adjustable members, wherein each of the plurality of adjustable members are elongated and linearly shaped bars that can be attached to each other in succession at attachment points such that each of the plurality of adjustable members impart adjustable movement that allows for dimensions and position of the apparatus to be adjustably changed, wherein at least one adjustable member and the hooked member are movably attached at an attachment point; and a plurality of accessories, wherein the accessories are attached to at least one of the plurality of adjustable members such that each of the plurality of accessories are positioned based on the movement of the plurality of the adjustable members;

wherein the plurality of accessories comprises:

a mirror assembly, wherein the mirror assembly is an enclosing frame having a mirror disposed therein forming a front surface of the mirror assembly and an additional mirror disposed therein forming a rear surface of the mirror assembly; and a receptacle having at last one flat surface forming a receptacle base for items to be stably rested upon;

wherein the plurality of adjustable members further comprises:

a first adjustable member attached at least to the hooked member, wherein the first adjustable member is attached to a distal end of the hooked member proximal to the extend portion;

a second adjustable member attached at least to the plurality of accessories, wherein the second adjustable member is attached to a lateral edge of the mirror assembly or a lateral edge of the receptacle; and a third adjustable member attached at least to the first adjustable member and the second adjustable member, wherein the third adjustable member is attached to the first adjustable member at a distal end of the bar via a first attachment point and attached to the second adjustable member at an opposing distal end of the bar via a second attachment point.

2. The apparatus of claim 1, wherein the adjustable movement imparted by each of the plurality of adjustable members comprises: expanding, collapsing, and rotating.

3. The apparatus of claim 2, wherein each of the plurality of adjustable members can be adjustable moved for expanding by extending each of the plurality of members outward and away from the hooked member.

4. The apparatus of claim 3, wherein fully expanding each of the plurality of adjustable members adjusts the dimensions and position of the apparatus to an increased height and width, positions the plurality of adjustable members to extend away from each other sequentially to form a linearly extended arm, and positions the plurality of accessories to a specific height with respect to a user.

5. The apparatus of claim 2, wherein each of the plurality of adjustable members can be adjustable moved for collapsing by retracting each of the plurality of members inward and towards the hooked member.

6. The apparatus of claim 5, wherein fully collapsing each of the plurality of adjustable members adjusts the dimensions and position of the apparatus to a deceased height and width, and positions the plurality of adjustable members parallel to each other.

7. The apparatus of claim 1, wherein an opened end of the curved hook portion can be oriented to the right of the mirror assembly and the receptacle forming a right-handed configuration for the assembly.

8. The apparatus of claim 1, wherein an opened end of the curved hook portion can be oriented to the left of the mirror assembly and the receptacle forming a left-handed configuration for the assembly.

9. A method of positioning an apparatus for use, the method comprising:

positioning a surface of the apparatus to be aligned horizontally against a horizontally flat stationary surface; and adjustably moving a member of the apparatus to extend upward to an elevated and vertically increased angle with respect to the flat stationary surface;

wherein the apparatus comprises:

a hooked member, wherein the hooked member is an elongated and linearly shaped bar having an extended portion and a curved hooked portion;

a plurality of adjustable members, wherein each of the plurality of adjustable members are elongated and linearly shaped bars that can be attached to each other in succession at attachment points such that each of the plurality of adjustable members impart adjustable movement that allows for dimensions and position of the apparatus to be adjustably changed, wherein at least one adjustable member and the hooked member are movably attached at an attachment point;

a plurality of accessories comprising a mirror assembly, wherein the mirror assembly is an enclosing frame having a mirror disposed therein and a receptacle having at least one flat surface forming a receptacle base for items to be stably rested upon; and wherein the accessories are attached to at least one of the plurality of adjustable members such that each of the plurality of accessories are positioned based on the movement of the plurality of the adjustable members.

10. The method of claim 9, wherein positioning a surface of the apparatus comprises placing the hooked member stably against the flat stationary surface for providing stabilized and balanced support for the apparatus while in use.

11. The method of claim 10, further comprising:

adjustably moving another member of the apparatus to extend upward to an elevated and vertically increased angle with respect to the flat stationary surface such that the plurality of accessories attached to the apparatus are positioned at a specific height with respect to the horizontally flat stationary surface.

12. The method of claim 11, further comprising:

adjustably rotating the plurality of accessories attached to the apparatus for positioning the plurality of accessories in a specific direction towards a user.

13. The method of claim 11, further comprising:

adjustably rotating a receptacle of the plurality of accessories for positioning at least one flat surface of the receptacle to be horizontally parallel to the horizontally flat stationary surface and forming a stable base of the receptacle for items to be stably placed upon.

14. A method of positioning an apparatus for use, the method comprising:

adjustably moving a hooked member of the apparatus to extend downwards to a declined and vertically lower angle with respect to a body of the apparatus; and positioning the hooked member of the apparatus to be underneath a leg of a user;

wherein the apparatus comprises:

the hooked member, wherein the hooked member is an elongated and linearly shaped bar having an extended portion and a curved hooked portion;

a plurality of adjustable members, wherein each of the plurality of adjustable members are elongated and linearly shaped bars that can be attached to each other in succession at attachment points such that each of the plurality of adjustable members impart adjustable movement that allows for dimensions and position of the apparatus to be adjustably changed, wherein at least one adjustable member and the hooked member are movably attached at an attachment point;

a plurality of accessories comprising a mirror assembly, wherein the mirror assembly is an enclosing frame having a mirror disposed therein and a receptacle having at least one flat surface forming a receptacle base for items to be stably rested upon; and wherein the accessories are attached to at least one of the plurality of adjustable members such that each of the plurality of accessories are positioned based on the movement of the plurality of the adjustable members.

15. The method of claim 14, wherein positioning the hook member of the apparatus underneath the leg of the user comprises placing the hook member stably against a flat stationary surface that is underneath the leg of the user for providing stabilized and balanced support for the apparatus while in use.

16. The method of claim 15, further comprising:

adjustably moving another member of the apparatus to extend upward to an elevated and vertically increased angle with respect to the leg of the user such that the plurality of accessories attached to the apparatus are positioned at a specific height with respect to the user.

17. The method of claim 15, wherein positioning the hook member of the apparatus underneath the leg of the user comprises rotating the hook member.

18. The method of claim 15, further comprising:

adjustably rotating a receptacle of the plurality of accessories for positioning at least one flat surface of the receptacle to be horizontally parallel to the leg of the user and forming a stable base of the receptacle for items to be stably placed upon.

* * * * *